US007582401B2

(12) United States Patent
Ogawa et al.

(10) Patent No.: US 7,582,401 B2
(45) Date of Patent: Sep. 1, 2009

(54) TONER WITH HYBRID BINDER RESIN

(75) Inventors: Yoshihiro Ogawa, Numazu (JP); Yusuke Hasegawa, Sunto-gun (JP); Tomohisa Sano, Sunto-gun (JP); Junko Nishiyama, Sunto-gun (JP); Miho Okazaki, Susono (JP); Takashige Kasuya, Sunto-gun (JP); Koji Nishikawa, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 174 days.

(21) Appl. No.: 11/407,257

(22) Filed: Apr. 20, 2006

(65) Prior Publication Data

US 2006/0240352 A1 Oct. 26, 2006

(30) Foreign Application Priority Data

Apr. 22, 2005 (JP) ..... 2005-124977
Mar. 24, 2006 (JP) ..... 2006-083544

(51) Int. Cl.
*G03G 9/087* (2006.01)

(52) U.S. Cl. ..... 430/109.3; 430/111.4

(58) Field of Classification Search ..... 430/109.3, 430/111.4

See application file for complete search history.

(56) References Cited

U.S. PATENT DOCUMENTS

| | | | | |
|---|---|---|---|---|
| 4,246,332 | A | 1/1981 | Tanaka et al. | 430/109 |
| 4,931,370 | A | 6/1990 | Amaya et al. | 430/45 |
| 5,972,553 | A | 10/1999 | Katada et al. | 430/110 |
| 5,976,752 | A | 11/1999 | Matsunaga et al. | 430/110 |
| 6,017,669 | A | 1/2000 | Unno et al. | 430/109 |
| 6,485,875 | B1 | 11/2002 | Karaki et al. | 430/108.23 |
| 6,881,527 | B2 | 4/2005 | Moribe et al. | 430/109.4 |
| 7,001,703 | B2 | 2/2006 | Moribe et al. | 430/109.4 |
| 7,097,951 | B2 | 8/2006 | Moribe et al. | 430/108.3 |
| 2004/0072087 | A1* | 4/2004 | Matsunaga et al. | 430/111.4 |
| 2004/0115549 | A1* | 6/2004 | Ishii et al. | 430/109.3 |
| 2004/0152813 | A1 | 8/2004 | Shirai | 524/275 |
| 2006/0240352 | A1 | 10/2006 | Ogawa et al. | 430/109.3 |

FOREIGN PATENT DOCUMENTS

| | | |
|---|---|---|
| JP | 54-114245 | 9/1979 |
| JP | 56-116043 | 9/1981 |
| JP | 58-102246 | 6/1983 |
| JP | 58-159546 | 9/1983 |
| JP | 01-156759 | 6/1989 |
| JP | 02-000881 | 1/1990 |
| JP | 09-006050 | 1/1997 |
| JP | 09-106102 | 4/1997 |
| JP | 09-146305 | 6/1997 |
| JP | 11-153885 | 6/1999 |
| JP | 2000-56511 | 2/2000 |
| JP | 2005099428 | 4/2005 |

* cited by examiner

*Primary Examiner*—Christopher RoDee
(74) *Attorney, Agent, or Firm*—Fitzpatrick, Cella, Harper & Scinto

(57) ABSTRACT

The invention is to provide a toner excellent in fixing property, high-temperature offset resistance and blocking resistance, and having an excellent developing property. The invention provides a toner including at least a binder resin and a colorant, wherein: the binder resin contains a hybrid resin which contains a polyester-type resin unit by 50 mass % or more and in which a polyester-type resin component and a vinyl-type resin component are chemically bonded; the toner contains 3 to 50 mass % of a tetrahydrofuran-insoluble matter derived from the binder resin; the tetrahydrofuran-insoluble matter contains a hybrid resin; and a tetrahydrofuran-soluble matter, obtained by hydrolyzing the tetrahydrofuran-insoluble matter and separating by filtration, has, in a GPC-measured molecular weight distribution, a main peak within a molecular weight range of 50,000 to 500,000.

7 Claims, No Drawings

TONER WITH HYBRID BINDER RESIN

BACKGROUND OF THE INVENTION

1. Field of the Invention

The present invention relates to a toner for use in an image forming method, such as an electrophotographic method, an electrostatic recording method or a toner jet method.

2. Related Background Art

As a binder resin for toner, a polycondensation resin such as polyester resin and a vinyl-type resin such as styrene-type resin have been employed principally. The polyester resin has an advantage of being excellent in the fixing property, but is difficult to make in a high molecular weight, and has a drawback of easily causing an offset phenomenon at a high temperature.

However, when a crosslinking component is added, in order to avoid such drawbacks, in the polyester resin for elevating the melt viscosity of resin and improving the high-temperature offset resistance, there result deteriorations not only in the fixing property but also in the pulverizing property at the toner manufacture.

On the other hand, the vinyl-type resin such as styrene-type resin is excellent in the pulverizing property at the toner manufacture and in the high-temperature offset resistance because a high molecular weight can be easily attained, but the blocking property and the developing property tend to be deteriorated in a lower molecular weight or a lower Tg for improving the fixing property.

Also various methods of using these two resins in a mixture have been investigated, in order to effectively exploit the advantages of these resins and to cover the drawbacks thereof.

Japanese Patent Application Laid-open No. S54-114245 discloses a toner containing a mixed resin of a polyester resin and a vinyl-type resin. However, the polyester resin and the vinyl-type resin are basically poor in the mutual solubility, and a colorant or a wax added to the toner shows insufficient dispersibility, thus tending to result in an insufficient developing property.

Japanese Patent Application Laid-open No. S56-116043 discloses a toner comprising a polymer obtained by polymerizing a vinyl-type monomer in the presence of a reactive polyester resin, but the content of the polyester resin is low with respect to the vinyl-type monomer, thus showing little improving effect on the fixing property.

Japanese Patent Application Laid-open No. S58-159546 discloses a toner comprising a polymer obtained by polymerizing an styreneacrylic monomer in the presence of a saturated polyester resin. However, for improving the fixing property and the high-temperature offset resistance, a control is essential on the molecular weight distribution of the binder resin, the mere polymerization of a styreneacrylic monomer in the presence of a saturated polyester resin is insufficient.

Japanese Patent Application Laid-open No. S58-102246 discloses a toner comprising a polymer obtained by polymerizing a styreneacrylic monomer in the presence of an unsaturated polyester resin. However, with respect to the vinyl-type monomer, the amount of polyester resin is as low as 99.5:0.5 to 91:9, thus showing little improving effect on the fixing property.

Japanese Patent Application Laid-open No. H01-156759 discloses a toner containing, as the binder resin, a graft polymer which is obtained by graft polymerization of a vinyl-type monomer to an unsaturated polyester resin and which has a weight-average molecular weight of 8,000 to 20,000, a melt viscosity at 100° C. of $10^4$ to $10^6$ poise, and a glass transition temperature of 50 to 75° C. However, for further improvements in the fixing property and the high-temperature offset resistance, a more precise control on the molecular weight distribution of the toner is necessary.

Japanese Patent Application Laid-open No. H02-881 discloses a toner comprising a polymer obtained by esterifying a styrene-type resin having acid group and a polyester resin. In such method, though the mutual solubility of the polyester resin and the vinyl-type copolymer can be improved, but the content of the gel component and the molecular weight of the vinyl-type resin component contained in the gel component are not controlled, so that it is insufficient for satisfying the fixing property and the high-temperature offset resistance at a higher level.

Japanese Patent Application Laid-open No. H11-153885 discloses a binder for electrophotographic toner, obtained by reacting a non-linear polyester having a weight-average molecular weight (Mw) of 5,000 to 200,000, and a ratio (Mw/Mn) of weight-average molecular weight (Mw) and number-average molecular weight (Mn) of 3 to 50, and a vinyl-type polymer. In this method, since the vinyl-type polymer and the polyester polymer are hybridized by an esterification reaction, a higher reaction temperature is required for obtaining a higher hybridization rate, and the vinyl-type polymer may be decomposed by heat. At a temperature not decomposing the vinyl-type polymer, the esterification reaction does not proceed sufficiently, so that a sufficient hybridization is difficult to attain, whereby the fixing property, high-temperature offset resistance and developing property are difficult to satisfy.

Also various proposals have been made referring to the molecular weight distribution of a component soluble in tetrahydrofuran (THF) in the toner.

Japanese Patent Application Laid-open No. H09-6050 discloses a relationship, in a component with a molecular weight of 50,000 or less in the GPC molecular weight distribution of a THF-soluble matter in the toner binder resin, between a weight-average molecular weight measured by a light scattering method and a weight-average molecular weight measured by a GPC method. However, such limitation on the low molecular side does not take into consideration a mixing property of the low molecular weight component and the high molecular weight component. As the low-temperature fixing property and the offset resistance are mutually contradictory in a sense, improvement is still insufficient in the low-temperature fixing property while maintaining the high-temperature offset resistance.

Japanese Patent Application Laid-open No. H09-146305 discloses, in the toner binder resin within a molecular weight range of 2,000 to 100,000, a relationship between a weight-average molecular weight measured by the light scattering method and an inertial radius. Also Japanese Patent Application Laid-open No. H09-106102 defines, in components of the GPC-measured molecular weight ranges of 2,000 to 50,000 and 100,000 or higher, a relationship between a weight-average molecular weight measured by the light-scattering method and an inertial radius. However, in recent high-speed image forming apparatuses, such branched structure cannot be considered optimum, and a branched structure capable of achieving the fixing performance in a wider temperature range has to be proposed anew. Also in consideration of the dispersibility between the binder resin and other materials such as a releasing agent at the toner manufacture, the branched structure in the component of the high molecular weight range still has a room for further consideration.

Thus, further improvements in the fixing property, high-temperature offset resistance and developing property are required, and the development of a better toner is strongly desired.

SUMMARY OF THE INVENTION

An object of the present invention is to provide a toner excellent in a fixing property, a high-temperature offset resistance and a blocking resistance.

Another object of the present invention is to provide a toner having an excellent developing property.

The present invention is to provide a toner containing at least a binder resin and a colorant, wherein:

the binder resin contains a hybrid resin which contains a polyester-type resin unit by 50 mass % or more and in which a polyester-type resin component and a vinyl-type resin component are chemically bonded;

the toner includes a tetrahydrofuran-insoluble matter, derived from the binder resin, by 3 mass % or more and 50 mass % or less;

the tetrahydrofuran-insoluble matter contains the hybrid resin; and a tetrahydrofuran-soluble matter, obtained by hydrolyzing the tetrahydrofuran-insoluble matter and separating by filtration, has, in a GPC-measured molecular weight distribution, a main peak within a molecular weight range of 50,000 to 500,000.

DETAILED DESCRIPTION OF THE PREFERRED EMBODIMENTS

The present inventors have found, in employing a hybrid resin in which a polyester resin component and a vinyl-type resin component are chemically bonded, a constitution capable of simultaneously satisfying a fixing property derived from the polyester resin component and a high-temperature offset resistance derived from the vinyl-type resin component, by controlling a molecular weight distribution of a vinyl-type resin component containing in a tetrahydrofuran-insoluble matter (gel component).

The binder resin to be contained in the toner of the present invention is required, for securing a satisfactory fixing property, to contained the polyester-type resin component by 50 mass % or higher. A content of the polyester-type resin unit less than 50 mass % is difficult to provide a sufficient fixing property. In the present invention, the content of the polyester-type resin unit means a sum of the component present as polyester resin and a component present as a polyester-type resin component for example in the hybrid resin. The other vinyl-type resin component is contained in an amount 50 mass % or less in the binder resin, and preferably within a range of 10 to 50 mass % for attaining a satisfactory offset resistance.

Also the toner of the present invention includes a tetrahydrofuran-insoluble matter (gel component) derived from the binder resin, in an amount of 3 to 50 mass % (preferably 5 to 40 mass %, more preferably 5 to 30 mass % and specifically preferably 10 to 30 mass %), and contains the hybrid resin in such gel component. With a content of the tetrahydrofuran-insoluble matter less than 3 mass %, the satisfactory high-temperature offset resistance is difficult to obtain. Also with a content of the tetrahydrofuran-insoluble matter exceeding 50 mass %, it becomes difficult to disperse material such as colorant uniformly in the toner, thereby eventually deteriorating the chargeability of the toner and leading an image fog or an image density decrease.

The hybrid resin, containing both the polyester-type resin component and the vinyl-type resin component within a same molecule, can improve the dispersibility for both raw materials easily miscible with the polyester component (hydrophilic materials, for example a colorant such as a magnetic material) and raw materials easily miscible with the vinyl-type resin (low polarity materials, for example a wax component).

In particular, by including the hybrid resin in the tetrahydrofuran-insoluble matter (gel component), the wax component and the colorant such as magnetic material are facilitated to present in the vicinity of the gel component or to intrude therein, in the toner. When the wax component is present in the vicinity of the gel component, the wax component is fused at the fixing operation to facilitate softening of the gel component, thereby improving the sharp melting property of the toner and significantly improving the fixing property. Also in case the colorant such as the magnetic material, which is inherently not easily incorporated in the gel component, is fetched in the gel component, the uniform dispersibility of the materials is improved to stabilize the chargeability of the toner, thereby improving the developing property and the image quality.

Also in the toner of the present invention, a tetrahydrofuran-soluble matter (hereinafter, it may be optionally called as a residual substance), obtained by hydrolyzing the tetrahydrofuran-insoluble matter derived from the resin component and separating by filtration, has, in a GPC-measured molecular weight distribution, a main peak within a molecular weight range of 50,000 to 500,000 (preferably 50,000 to 300,000, more preferably 50,000 to 200,000). In the hydrolysis of the tetrahydrofuran-insoluble matter derived from the resin component, the component undergoing decomposition is the polyester-type resin units that are polymerized by ester bonds, while the vinyl-type resin component is not decomposed and remains in a polymer state. Therefore the residual substance after the hydrolysis is principally constituted of the vinyl-type resin component, and the THF-soluble matter in the residual substance therefore means a THF-soluble matter of the vinyl-type resin component.

In case of preparing a binder resin by merely mixing a polyester resin and a vinyl-type resin having a main peak within the molecular weight range of 50,000 to 500,000, such vinyl-type resin becomes a THF-soluble matter and is not included in the THF-insoluble matter in the initial stage, thus not meeting the constitution of the present invention. Also in case of preparing a binder resin by merely mixing a polyester resin and a vinyl-type resin containing a THF-insoluble matter, the vinyl-type resin remains in the THF-insoluble matter but remains THF-insoluble even after the hydrolysis, whereby the constitution of the present invention cannot be met.

The resin component meeting the constitution of the present invention can be obtained, for example, in a case where a polyester-type resin and a vinyl-type resin having a main peak in the molecular weight range of 50,000 to 500,000 are hybridized and the insolubility in THF is attained by such hybridization.

Therefore, in the residual substance, the fact that the THF-soluble matter has a main peak in the molecular weight range of 50,000 to 500,000 indicates that a vinyl-type resin component of a high molecular weight (namely having a main peak in the molecular weight range of 50,000 to 500,000) is hybridized with the polyester-type resin component.

Thus, a binder resin, in which a tetrahydrofuran-soluble matter, obtained as a residual substance of a hydrolysis of the tetrahydrofuran-insoluble matter derived from the resin component, has, in a GPC-measured molecular weight distribution, a main peak within a molecular weight range of 50,000 to 500,000, has a high molecular weight and has a gel structure with a high molecular weight between crosslinking points. Therefore, such binder resin, when employed in a toner, even though the toner is prepared via melt-kneading and so on, the gel component is cut off with difficulty, and therefore, without carrying out the treatment of producing the gel component (for example metal crosslinkage) again, can provide a satisfactory anti-offset property.

The toner containing such tetrahydrofuran-insoluble matter can improve the fixing property, since the tetrahydrofuran-insoluble matter constituting the gel component easily undergoes a molecular movement even with a limited heat amount at the fixing operation whereby the binder resin is more easily softened by heat, in comparison with a case of containing a gel component of a smaller molecular weight between the crosslinking points. Also the above-mentioned gel component can maintain a high viscosity even at a high temperature, thus improving the high-temperature offset resistance. Also, as the high-temperature offset resistance can be maintained even with a small amount of gel component, the low-molecular weight component can be included in a larger amount, thereby allowing to further improve the fixing property.

In case the tetrahydrofuran-soluble matter, obtained as a residual substance of a hydrolysis of the tetrahydrofuran-insoluble matter, has a main peak molecular weight less than 50,000, the gel component tends to become harder to deteriorate the fixing property. Also the molecular weight between the crosslinking points becomes smaller, whereby the gel component loses flexibility and is easily cleavable by the shearing force at the kneading operation in toner manufacture, thereby deteriorating the high-temperature offset resistance. In case the main peak molecular weight exceeds 500,000, the gel component becomes less easily dispersible in the toner, as the result, uniform dispersion of other components contained in the toner is inhibited, and therefore charging property as a toner is deteriorated. The molecular weight distribution of the tetrahydrofuran-soluble matter, obtained as the a residual substance of hydrolysis of the polyester-type resin component contained in the tetrahydrofuran-insoluble matter, can be measured by the following procedure.

At first, a tetrahydrofuran-insoluble matter derived from the binder resin is taken out from the toner, then the tetrahydrofuran-insoluble matter is heated in an alkaline aqueous solution to hydrolyze and remove the polyester-type resin unit. As the vinyl-type resin component is not hydrolyzed but remains as a resin component, the residual substance is extracted and subjected to a GPC molecular weight measurement. More specific measuring method is shown in the following.

(1) Separation of Tetrahydrofuran-Insoluble Matter

Weighed toner is charged in a cylindrical filter paper (such as No. 86R of a size of 28 mm (height)×10 mm (diameter), manufactured by Toyo Filter Paper Co.) and placed in a Soxhlet's extractor. 200 ml of tetrahydrofuran are employed as the solvent to extract a tetrahydrofuran-soluble matter for 16 hours. The extraction is conducted with such a refluxing rate that an extraction cycle with tetrahydrofuran is executed every 4 to 5 minutes. After the extraction, the cylindrical filter paper is taken out, and the tetrahydrofuran-insoluble matter of the toner, remaining on the filter paper, is collected.

In case the toner is a magnetic toner containing a magnetic material, the tetrahydrofuran-insoluble matter thus collected is placed in a beaker and is sufficiently dispersed by adding tetrahydrofuran, and then a magnet is held close to the bottom of the beaker to precipitate and fix the magnetic material on the bottom of the beaker. In such state, tetrahydrofuran and the gel component dispersed therein are transferred to another container, thereby removing the magnetic material, and then tetrahydrofuran is evaporated to separate the tetrahydrofuran-insoluble matter derived from the binder resin.

(2) Separation of Residual Substance by Hydrolysis

The obtained tetrahydrofuran-insoluble matter, derived from the binder resin, is dispersed with a concentration of 1 mass % in a 2 mol/L aqueous solution of NaOH, and is subjected to a hydrolysis in an autoclave under conditions of 150° C., 24 hours. The residual substance after the hydrolysis is separated by filtration from the hydrolyzed liquid, according to either of the following procedures:

i) In case the THF-insoluble matter does not contain a component having an ester structure:

The hydrolyzed liquid is suction filtered with a membrane filter to separate the residual substance. By this operation, the monomer component, which is the decomposed substance of the polyester-type resin unit, is removed in the filtrate.

ii) In case the THF-insoluble matter contains a component having an ester structure, such as an acrylate ester or a methacrylate ester:

As the residual substance present in the hydrolyzed liquid is in a state of a sodium salt (—$COO^-Na^+$), the residual substance separated by filtration is dispersed again in water, then hydrochloric acid is added to pH=2 to change —$COO^-$ to —COOH. Then the residual substance is separated by filtration with a membrane filter.

(3) GPC Measurement of Component Separated in (2):

The component separated in (2) is dissolved in tetrahydrofuran and is subjected to a molecular weight measurement by GPC.

The tetrahydrofuran-insoluble matter preferably contains 30 mass % or more and 80 mass % or less of the vinyl-type resin component. The content of the vinyl-type resin component in the tetrahydrofuran-insoluble matter can be measured as follows.

Firstly, polyester resin is polymerized with the same monomer compositional components as the monomer compositional components of the polyester-type resin composition used in the polymerization of the hybrid resin. Similarly, vinyl-type resin is polymerized with the same monomer compositional components as the monomer compositional components of the vinyl-type composition used in the polymerization of the hybrid resin. The polyester resin obtained and the vinyl-type resin obtained are well mixed and the mixture is calibration curve sample. Several points (preferably 3 to 7 points) of the mixed samples in which the proportion of the polyester-type resin and the vinyl-type resin is arbitrarily changed are prepared, and the calibration curves ar prepared by IR measurement. The content of the vinyl-type resin component in the tetrahydrofuran-insoluble matter is calculated by using the calibration curves. For example, in Hybrid Resin Production Example 1 described later, as a peak of the polyester, the sum of the area of peak (about 730 $cm^{-1}$) derived from benzene ring of phthalic acid and the area of peak (about 830 $cm^{-1}$) derived from benzene ring of bisphenol derivative is polyester resin portion, and as a peak of the vinyl-type resin, the area of peak (about 700 $cm^{-1}$) derived from benzene ring of styrene is viny resin portion, and based on the calibration curve the content of the vinyl-type resin component is calculated.

In the toner of the present invention, the THF-soluble matter of the toner preferably has, in the GPC-measured molecular weight distribution, a main peak within a molecular weight range of 2,000 to 30,000 (preferably 3,000 to 20,000, and more preferably 5,000 to 10,000), and preferably contains a component within a molecular weight range of 40,000 to 1,000,000 by 3 to 30 mass % (preferably 5 to 25 mass % and more preferably 5 to 20 mass %).

The molecular weight distribution of the THF-soluble matter of the toner, having a main peak in the low molecular weight region, also containing a specified amount of a component in the high molecular weight region, and further containing the aforementioned gel component allows to obtain a stable developing property over a prolonged period (high durability) while maintaining a fixing property and a high-temperature offset resistance of a high level.

The hybrid resin having a high molecular weight between the crosslinking points, featuring the present invention, can easily incorporate a low molecular weight component having a peak molecular weight at 2,000 to 30,000, so that the gel component can be easily fused by heat, thereby improving the fixing property. Also the high-temperature offset resistance can improved as the high molecular weight component with a molecular weight range of 40,000 to 1,000,000 enhances miscibility of the low molecular weight component and the gel component. Also the gel component can be uniformly mixed in the toner to improve the pulverizing property at the toner manufacture, thus significantly reducing ultrafine powder and coarse powder generated at the pulverizing operation. As a result, factors hindering the chargeability of the toner are reduced to obtain an excellent durability in the developing operation.

In the THF-soluble matter of the toner, a main peak molecular weight less than 2,000 may deteriorating the storability and the developing property of the toner, and a main peak molecular weight exceeding 30,000 tends to deteriorate the fixing property.

In the THF-soluble matter of the toner, in case the component within a molecular weight range of 40,000 to 1,000,000 has a content less than 3 mass %, the uniform miscibility of the gel component tends to be deteriorated, thereby becoming unable to obtain a sufficient improvement in the high-temperature offset resistance and easily generating ultrafine powder and coarse powder at the pulverizing operation, leading to a deteriorated durability in the development. Also in case the component within a molecular weight range of 40,000 to 1,000,000 has a content exceeding 30 masse, the toner viscosity tends to become excessively high to deteriorate the fixing property.

Also in the toner of the present invention, in the THF-soluble matter obtained by dissolving the toner in tetrahydrofuran for 24 hours at 25° C., it is preferable that a component having an absolute molecular weight M of $5.0\times10^5$ as measured by a GPC-RALLS viscosimeter analysis has a inertial square radius Rt of 6.0 to 20.0 nm, and more preferable that a component having an absolute molecular weight M of $1.0\times10^7$ has a inertial square radius Rt of 50.0 to 100.0 nm.

A toner satisfying such feature relating to the inertial square radius includes a component of a branched structure of an appropriate spreading, and capable of showing an improved affinity among the gel component, the high molecular weight component and the low molecular weight component, and also attaining further improvements in the low-temperature fixing property, high-temperature offset resistance, and blocking resistance (storability).

The GPC-RALLS viscosimeter analysis apparatus has three different detectors, namely a refractance detector, a light sctattering detector and a viscosity detector, and is capable of measuring a molecular size (inertial square radius) of a polymer and an absolute molecular weight not depending on the polymer type. It is therefore capable of observing the absolute molecular weight and the molecular size (inertial square radius) of the toner, and also a branched state of the toner.

When a component having an absolute molecular weight M of $5.0\times10^5$ has a inertial square radius Rt within a range of 6.0 to 20.0 nm (preferably 8.0 to 20.0 and more preferably 10.0 to 18.0 nm), it means presence of spreading molecules, having chains branched from a large main chain. It is estimated that such molecules improve the mixing of the high molecular weight component and the low molecular weight component, thereby improving the low-temperature fixing property.

Also when a component having an absolute molecular weight M of $1.0\times10^7$ has a inertial square radius Rt of 50.0 to 100.0 nm (preferably 50.0 to 90.0 nm and more preferably 50.0 to 80.0 nm), it means presence of a soluble component having a branched structure close to that of the gel component. Such component is estimated to serve as a kind of connecting part when the gel component is dispersed in the toner, thereby improving the high-temperature offset resistance.

In a more preferred embodiment of the present invention, in the THF-soluble matter obtained by dissolving the toner in tetrahydrofuran for 24 hours at 25° C., it is preferable that a component having an absolute molecular weight M of $2.0\times10^6$ as measured by a GPC-RALLS viscosimeter analysis has a inertial square radius Rt of 16.0 to 60.0 nm (preferably 20.0 to 60.0 nm and more preferably 50.0 to 80.0 nm). In such case, the miscibility of the components can be improved further.

It is also preferable, when the logarithmic value (log[Rt]) of the inertial square radius Rt is plotted against the logarithmic value (log[Mw]) of the absolute molecular weight M, that an inclination ($k_L$) in an absolute molecular weight range of $5.0\times10^5$ to $2.0\times10^6$ and an inclination ($k_H$) in an absolute molecular weight range of $2.0\times10^6$ to $1.0\times10^7$ satisfy a following relation:

$$0.8 \leqq k_L/k_H \leqq 1.2 \ (0<k_L \text{ and } 0<k_H).$$

This relationship means that the level of branching increases relatively regularly from a low molecular weight to a high molecular weight, and realizes an appropriate mutual entanglement of the molecules, thereby providing a more conspicuous improvement in the fixing property.

The binder resin to be employed in the present invention may be the single hybrid resin only, but can also be a mixture containing other resin components as long as the hybrid resin is contained.

For example, it can be a mixture of the hybrid resin and a vinyl-type resin, a mixture of the hybrid resin and a polyester resin, or a mixture of a polyester resin, the hybrid resin and a vinyl-type resin.

The hybrid resin can be, for example, (i) a resin formed by executing an ester exchange reaction between a vinyl-type resin component, formed by polymerizing a monomer component having a carboxylate ester group such as acrylate ester or methacrylate ester, and a polyester-type resin component, (ii) a resin formed by an esterification reaction between a vinyl-type resin component, formed by polymerizing a monomer component having a carboxylate ester group such as acrylate ester or methacrylate ester, and a polyester component, or (iii) a resin formed by polymerizing a vinyl-type monomer in the presence of an unsaturated polyester resin component, formed by polymerizing a monomer having an unsaturated bond such as fumaric acid.

The hybrid resin can be obtained, as described in (i) and (ii) above, by including, in a vinyl-type resin component and/or a polyester resin component, a monomer component capable of reacting with both resin components and executing a reaction of these components. Among the monomers constituting the polyester resin component, those capable of reacting with the vinyl-type resin component include, for example, an unsaturated dicarboxylic acid such as fumaric acid, maleic acid, citraconic acid or itaconic acid, or an anhydride thereof. Also among the monomers constituting the vinyl-type resin component, those capable of reacting with the polyester resin component include, for example, a vinyl monomer having a carboxyl group such as acrylic acid or methacrylic acid, or a vinyl monomer having a hydroxyl group.

The hybrid resin to be employed in the present invention can be prepared, for example, by following producing methods (1) to (5):

(1) A vinyl-type resin and a polyester resin are prepared separately, then they are dissolved/swelled in a small amount of an organic solvent, and an esterification catalyst and an alcohol are added under heating to execute an ester exchange reaction, thereby obtaining a hybrid resin having the polyester resin component and the vinyl-type resin component.

(2) After a vinyl-type resin is prepared, in its presence a polyester resin component is generated, thereby obtaining a hybrid resin having the polyester resin component and the vinyl-type resin component. An organic solvent may be suitably employed also in this case.

(3) After a polyester resin is prepared, in its presence a vinyl-type resin component is generated and reacted, thereby obtaining a hybrid resin having the polyester resin component and the vinyl-type resin component.

(4) After preparation of a vinyl-type resin and a polyester resin, a vinyl-type monomer and/or a polyester monomer (alcohol, carboxylic acid) is added in the presence of these polymer components, thereby obtaining a hybrid resin. An organic solvent may be suitably employed also in this case.

(5) A vinyl-type monomer and a polyester monomer (alcohol, carboxylic acid) are mixed to execute an addition polymerization reaction and a polycondensation reaction in continuation, thereby obtaining a hybrid resin having the polyester resin component and the vinyl-type resin component. Also an organic solvent may be suitably employed.

In the producing methods (1) to (5) above, the vinyl-type resin component and/or the polyester resin component may be formed by plural polymer components different in molecular weight, or crosslinking degree.

The present invention particularly preferably employs the producing method (3), and a hybrid resin which is obtained by dissolving an unsaturated polyester resin, capable of reacting with a vinyl-type monomer, in the vinyl-type monomer, and polymerizing the mixture of the polyester resin and the vinyl-type monomer by a bulk polymerization method.

The bulk polymerization method is preferably employed in the present invention, as it can increase the molecular weight of the vinyl-type resin component and can also increase the main peak molecular weight of the vinyl-type resin component contained in the gel component.

Also the bulk polymerization method allows, in comparison with a solution polymerization method, to obtain the binder resin at a lower cost, as it does not require a step of distilling off the solvent. Also the binder resin obtained by the bulk polymerization method has less impurities such as a dispersant, in comparison with the binder resin produced by a suspension polymerizaiton method, thus showing little influence on the chargeability of the toner and being very preferable for use in the toner.

In particular, the binder resin to be employed in the present invention is preferably a hybrid resin obtained by a bulk polymerization of a vinyl-type monomer in the presence of an unsaturated polyester resin, with a weight ratio of the unsaturated polyester resin to the vinyl-type monomer of 50:50 to 90:10 (preferably 60:40 to 80:20). A weight ratio of the unsaturated polyester resin less than 50:50 may deteriorate the fixing property, and a weight ratio higher than 90:10 tends to deteriorate the high-temperature offset resistance.

The unsaturated polyester resin, to be employed in the hybrid resin obtained by the bulk polymerization method of the present invention, is preferably an unsaturated polyester resin of such a low molecular weight that a THF-soluble matter has, in the GPC-measured molecular weight distribution, a main peak within a molecular weight range of 2,000 to 30,000 (preferably 3,000 to 20,000 and more preferably 5,000 to 10,000). It is particularly preferably a linear unsaturated polyester resin, not containing a gel component. A main peak molecular weight less than 2,000 may deteriorate the developing property, and a main peak molecular weight exceeding 30,000 may deteriorate the fixing property.

Further, in the unsaturated polyester resin to be employed in the present invention, a THF-soluble matter preferably has a number-average molecular weight (Mn) within a range of 2,000 to 20,000 (more preferably 3,000 to 10,000). A number-average molecular weight (Mn) less than 2,000 does not easily generate a gel component in the hybrid resin, thereby tending to deteriorate the high-temperature offset resistance and the durability in development. A number-average molecular weight (Mn) exceeding 20,000 reduces the solubility of the unsaturated polyester resin in the vinyl-type monomer, whereby the hybrid resin becomes difficult to obtain by the bulk polymerization. There may also result a separation of the polyester-type resin and the vinyl-type resin, and a reduced chargeability of the toner.

Also the unsaturated polyester resin to be employed in the present invention, in consideration of a sharp melting property at the fixing operation, preferably has a ratio (Mw/Mn) of a weight-average molecular weight (Mw) and a number-average molecular weight (Mn) within a range of 1.0 to 5.0 (more preferably 1.0 to 3.0).

Also the unsaturated polyester resin to be employed in the present invention preferably has an acid value of 0.1 to 30 mgKOH/g (preferably 1 to 20 mgKOH/g and more preferably 1 to 10 mgKOH/g), and a hydroxyl value of 10 to 60 mgKOH/g (preferably 20 to 60 mgKOH/g and more preferably 30 to 50 mgKOH/g), in order to provide the toner with a satisfactory chargeability.

A bulk polymerization of the vinyl-type monomer in the presence of such unsaturated linear polyester resin allows to obtain a hybrid resin of a molecuar structure, containing a vinyl-type resin component of a high molecular weight and a high linearity as a main chain, and also having a low molecular weight polyester resin component branched from the vinyl-type resin component. Also an acid group and a hydroxyl group in the hybrid resin of such branched structure form an intermolecular ester bond to promote gel formation.

The gel component, formed by thus prepared hybrid resin, has a high molecular weight between the crosslinking points and is easily softened by heat. Also as it contain a large amount of the polyester-type resin component within the molecular structure, it can incorporate a large amount of non-hybridized low-molecular weight polyester-type resin component within the gel structure. It is therefore rendered possible to retain the mechanical strength of the toner even when the low-molecular weight polyester-type resin component of a low softening point is added in a large amount, thereby achieving an excellent fixing property and a development durability at the same time. Also the gel component, having a large molecular weight between the crosslinking points and a high linearity, is resistant to a shearing force because of the flexible molecular structure, thus not easily cause of a molecular cleavage in the kneading step of the toner manufacture. Therefore, a predetermined amount of gel component can be included in the toner regardless of the kneading condition, and an excellent high-temperature offset resistance can be stably given to the toner.

In the following, there will be shown examples of the monomer employable in the formation of the polyester resin unit.

A divalent alcohol component can be ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol-A, a bisphenol represented by a formula (A) or a derivative thereof:

(A)

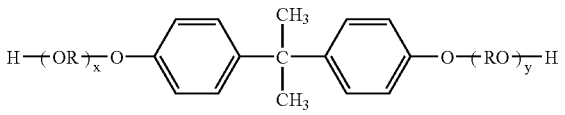

wherein R represents an ethylene group or a propylene group; and x and y each represents an integer of 0 or larger, with x+y having an average value from 0 to 10;

or a diol represented by a formula (B):

(B)

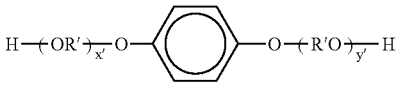

wherein R' represents —$CH_2CH_2$—, —$CH_2$—$CH(CH_3)$— or —$CH_2$—$C(CH_3)_2$—; x' and y' each represents an integer of 0 or larger, with x'+y' having an average value from 0 to 10.

A divalent acid component can be a dicarboxylic acid or a derivative thereof, for example a benzenedicarboxylic acid such as phthalic acid, terephthalic acid, isophthalic acid or phthalic anhydride or an anhydride or a lower alkyl ester thereof; an alkyldicarboxylic acid, such as succinic acid, adipic acid, cebasic acid or azelaic acid, or an anhydride or a lower alkyl ester thereof; or an alkenylsuccinic acid, an alkylsuccinic acid, such as n-dodecenylsuccinic acid or n-dodecylsuccinic acid, or an anhydride or a lower alkyl ester thereof.

Also an acid component having an unsaturated bond for obtaining the unsaturated polyester resin is preferably an unsaturated dicarboxylic acid such as fumaric acid, maleic acid, citraconic acid or itaconic acid, or an anhydride or a lower alkyl ester thereof.

Such unsaturated dicarboxylic acid is preferably employed in a proportion of 0.1 to 10 mol % (preferably 0.3 to 5 mol %, more preferably 0.5 to 3 mol %) with respect to the total acid component in the polyester monomer. The unsaturated dicarboxylic acid added within such range provides an appropriate concentration of the unsaturated bonds in the low molecular weight polyester molecules, thereby realizing a hybridization of the polyester resin and the vinyl-type resin with an appropriate distance between the crosslinking points.

Also a tri- or higher-valent alcohol component or a tri- or higher-valent acid component may be employed if necessary.

Examples of the tri- or higher-valent polyhydric alcohol include such as sorbitol, 1,2,3,6-hexanetetrol, 1,4-sorbitan, pentaerythritol, dipentaerythritol, tripentaerythritol, 1,2,4-butantriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of the tri- or higher-valent carboxylic acid include polyvalent carboxylic acids and derivatives thereof, such as pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, empol trimer acid, or an anhydride or a lower alkyl ester thereof; a tetracarboxylic acid represented by a following formula:

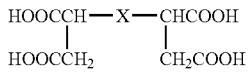

(wherein X represents an alkylene group or an alkenylene group with 5 to 30 carbon atoms having at least a side chain with 3 or more carbon atoms), or an anhydride or a lower alkyl ester thereof. Among these, 1,2,4-benzenetricarboxylic acid, 1,2,5-benzenetricarboxylic acid, or an anhydride or a lower alkyl ester thereof, is preferred.

In the polyester-type resin unit, the alcohol component preferably represents 40 to 60 mol % (more preferably 45 to 55 mol %), and the acid component preferably represents 60 to 40 mol % (more preferably 55 to 45 mol %). Also the tri- or higher-valent component preferably represents 0.1 to 60 mol % (more preferably 0.1 to 20 mol %) of all the components.

The polyester-type resin can be obtained by an ordinary known polycondensation. The polymerization reaction of the polyester resin is executed, normally in the presence of a catalyst, under a temperature condition of 150 to 300° C., preferably about 170 to 280° C. Also the reaction can be executed under a normal pressure, an elevated pressure or a reduced pressure, but is preferably executed, after reaching a predetermined reaction degree (for example about 30 to 90%), by reducing the pressure of the reaction system to 200 mmHg or less, preferably 25 mmHg or less and further preferably 10 mmHg or less.

The above-mentioned catalyst can be a catalyst ordinarily employed in polyesterification, for example a metal such as tin, titanium, antimony, manganese, nickel, zinc, lead, iron, magnesium, calcium or germanium; or a compound containing such metal, such as dibutyl tin oxide, orthodibutyl titanate, tetrabutyl titanate, tetraisopropyl titanate, zinc acetate, lead acetate, cobalt acetate, sodium acetate or antimony trioxide.

In the present invention, in consideration of easy control of the polymerization reaction and high reactivity with the vinyl-type monomer, a titanium compound is preferably employed, particularly preferably tetraisopropyl titanate, dipotassium oxalate titanate, or potassium terephalate titanate. Also for preventing coloring of the binder resin, it is particularly preferable to add an antioxidant (particularly a phosphor-based antioxidant) or an auxiliary catalyst as a reaction promoter (preferably a magnesium compound, particularly preferably magnesium acetate).

The polyester-type resin of the present invention can be obtained by terminating the reaction when a property (for example an acid value or a softening point) of the reacted substance reaches a predetermined value, or when an agitating torque or an agitating power for the reaction device reaches a predetermined value.

In the present invention, the vinyl-type resin means a vinyl-type homopolymer or a vinyl-type copolymer.

A monomer for obtaining the vinyl-type resin can be as follows.

Examples include styrene; a styrene derivative such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, or p-n-dodecylstyrene; an ethylenic unsaturated monoolefin such as ethylene, propylene, butylene or isobutylene; an unsaturated polyene such as butadiene or isoprene; a halogenated vinyl such as vinyl chloride, vinyl bromide or vinyl fluoride; a vinyl ester such as vinyl acetate, vinyl propionate or vinyl benzoate; an α-methylenic aliphatic monocarboxylate ester such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, or diethylaminoethyl methacrylate; an acrylate ester such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, or phenyl acrylate; a vinyl ether such as vinyl methyl ether, vinyl ethyl ether, or vinyl isobutyl ether; a vinyl ketone such as vinyl methyl ketone, vinyl hexyl ketone or methyl isopropenyl ketone; an N-vinyl compound such as N-vinylpyrrole, N-vinylcarbazole, N-vinylindole or N-vinylpyrrolidone; a vinylnaphthalene; and an acrylic acid derivative or a methacrylic acid derivative such as acrylonitrile, methacrylonitrile or acrylamide. Such vinyl-type monomer may be employed singly or in a mixture of two or more kinds.

Among these, a monomer combination providing a styrene-type copolymer or a styrene-acrylic copolymer is preferable.

Also a monomer for regulating the acid value of the binder resin can be, for example, acrylic acid or an α- or β-alkyl derivative thereof such as acrylic acid, methacrylic acid, α-ethylacrylic acid or crotonic acid, or an unsaturated dicarboxylic acid such as fumaric acid, maleic acid or citraconic acid, or a monoester derivative thereof; or maleic anhydride, and a desired binder resin can be obtained by copolymerizing such monomer, either singly or in a mixture, with other monomers. Among these, a monoester derivative of an unsaturated dicarboxylic acid is particularly preferred in controlling the acid value.

More specific examples include a monoester of an α,β-unsaturated dicarboxylic acid such as monomethyl maleate, monoethyl maleate, monobutyl maleate, monooctyl maleate, monoallyl maleate, monophenyl maleate, monomethyl fumarate, monoethyl fumarate, monobutyl fumarate or monophenyl fumarate; a monoester of an alkenyldicarboxylic acid such as monobutyl n-butenylsuccinic acid, monomethyl n-octenylsuccinate, monoethyl n-butenylmalonate, monomethyl n-dodecenylglutarate, or monobutyl n-butenyladipate; and a monoester of an aromatic dicarboxylic acid such as monomethyl phthalate, monoethyl phthalate, or monobutyl phthalate.

Such carboxyl group-containing monomer may be employed in an amount of 0.1 to 30 mass % in all the monomers employed for synthesizing the vinyl-type resin.

The vinyl-type resin component contained in the gel component of the present invention preferably has a higher linearity and is therefore preferably free from a crosslinking component, but it is also possible, for attaining the objects of the present invention, to include a crosslinking monomer as shown in the following.

The crosslinking monomer is principally a monomer having two or more polymerizable double bonds. Examples include an aromatic divinyl compound (such as divinylbenzene or divinylnaphthalene); a diacrylate compound bonded by an alkyl chain (such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and an above-mentioned compound in which acrylate is replaced by methacrylate); a diacrylate compound bonded by an alkyl chain including an ether bond (such as diethyle glycol diacrylate, triethylene glycol diacrylate, tetraethylene glycol diacrylate, polyethylene glycol #400 diacrylate, polyethylene glycol #600 diacrylate, dipropylene glycol diacrylate, or an above-mentioned compound in which acrylate is replaced by methacrylate); a diacrylate compound bonded by a chain including an aromatic group and an ether bond (such as polyoxyethylene (2)-2,2-bis(4-hydroxyphenyl)propane diacrylate, polyoxyethylene (4)-2,2-bis(4-hydroxyphenyl)propane diacrylate, and an above-mentioned compound in which acrylate is replaced by methacrylate); a polyester-type diacrylate compound (such as MANDA (trade name), Nippon Kayaku Co.). Examples of a polyfunctional crosslinking agent include pentaerythritol acrylate, trimethylolethane triacrylate, trimethylolpropane triacrylate, tetramethylolpropane triacrylate, tetramethylolmethane tetraacrylate, oligoester acrylate, and an above-mentioned compound in which acrylate is replaced by methacrylate); triallyl cyanurate, and triallyl trimellitate.

Such crosslinking agent is preferably employed in an amount of 0.001 to 1 part by mass, with respect to 100 parts by mass of other vinyl-type monomers, and more preferably 0.001 to 0.05 parts by mass.

The vinyl-type resin is preferably generated either by singly employing a polyfunctional polymerization initiator as shown in the following, or by employing a polyfunctional polymerization initiator and a monofunctional polymerization initiator in combination.

Specific examples of the polyfunctional polymerization initiator having a polyfunctional structure include a polyfunctional polymerization initiator having two or more polymerization initiating functional groups such as peroxide groups within a molecule, such as 1,1-di-tert-butylperoxy-3,3,5-trimethylcyclohexane, 1,1-di-t-hexylperoxy-3,3,5-trimethylcyclohexane, 1,1-di-t-amylperoxy-3,3,5-trimethylcyclohexane, 1,1-di-t-butylperoxy-2-methylcyclohexane, 1,3-bis-(t-butylperoxyisopropyl)benzene, 1,3-bis-(neodecanolperoxyisopropyl)benzene, 2,5-dimethyl-2,5-di(t-butylperoxy)hexane, 2,5-dimethyl-2,5-di-(t-butylperoxy)hexine-3,2,5-dimethyl-2,5-di-(2-ethylhexanolperoxy)hexane, 2,5-dimethyl-2,5-di(m-toluolperoxy)hexane, 2,5-dimethyl-2,5-di-(benzoylperoxy)hexane, tris-(t-butylperoxy)triazine, 1,1-di-t-butylperoxycyclohexane, 1,1-di-t-hexylperoxycyclohexane, 1,1-di-t-amylperoxycyclohexane, 1,1-di-t-butylperoxycyclododecane, 2,2-di-t-butylperoxybutane, 4,4-di-t-butylperoxyvaleric acid n-butyl ester, di-t-butyl peroxyhexahydroterephthalate, di-t-butyl peroxyhexahydroisophthalate, di-t-butyl peroxyazelate, di-t-butyl peroxytrimethyladipate, 2,2-bis-(4,4-di-t-butylperoxycylohexyl)propane, 2,2-t-butylperoxyoctane or various polymer oxides; and a polyfunctional polymerization initiator having both a polymerization initiating functional group such as a peroxide group and a polymerizable unsaturated group within a molecule, such as diallyl peroxydicarbonate, t-butylperoxymalate, t-butyl peroxyallylcarbonate or t-butyl peroxyisopropylfumarate.

Among these, more preferable ones are 1,3-bis-(t-butylperoxyisopropyl)benzene, 2,5-dimethyl-2,5-di(t-butylperoxy)hexane, 2,5-dimethyl-2,5-di-(t-butylperoxy)hexine-3, and 2,2-bis-(4,4-di-t-butylperoxycyclohexyl)propane.

In consideration of efficiency, such polyfunctional polymerization initiator is preferably employed in an amount of 0.01 to 10 parts by mass, with respect to 100 parts by mass of the monomer.

Also in case such polyfunctional polymerization initiator is employed in combination with a monofunctional polymerization initiator, it is preferably employed in combination with a monofunctional polymerization initiator having a temperature at which the half-life becomes 10 hours (10-hour half-life temperature) lower than that of the polyfunctional polymerization initiator.

Specific examples include an organic peroxide such as benzoyl peroxide, n-butyl-4,4-di(t-butylperoxy)valerate, dicumyl peroxide, α,α'-bis(t-butylperoxydiisopropyl)benzene, t-butylperoxycumene, or di-t-butyl peroxide; and an azo or diazo compound, such as azobisisobutyronitrile or diazoaminoazobenzene.

Such monofunctional polymerization initiator may be added, simultaneously with the polyfunctional polymerization initiator, to the monomer, but, in order to maintain an appropriate efficiency of the polyfunctional polymerization initiator, it is preferably added after the vinyl-type monomer reaches a polymerization rate of 50 t or higher in the polymerization step.

In the binder resin of the present invention, the hybrid resin is preferably obtained, as explained above, by a bulk polymerization method of polymerizing the vinyl-type monomer in the presence of the aforementioned unsaturated polyester resin component, without utilizing a solvent or the like. It is particularly preferable to conduct the polymerization reaction by employing a polymerization initiator with a 10-hour half-life temperature of 100 to 150° C., at a temperature range from a temperature lower by 30° C. than the 10-hour half-life temperature of the catalyst to a temperature higher by 10° C., until the polymerization conversion rate of the vinyl-type monomer reaches 60%, preferably 80%, thereby increasing the molecular weight of the vinyl-type resin component generated by the bulk polymerization. It is also preferable, after the polymerization conversion rate reaches 60% (preferably 80%), to execute the polymerization reaction at a temperature higher than the 10-hour half-life temperature by 10° C. or more, thereby completing the reaction. The binder resin thus obtained preferably has an acid value of 0.1 to 50 mgKOH/g (preferably 1 to 40 mgKOH/g and more preferably 1 to 30 mgKOH/g), and a hydroxyl value of 5 to 80 mgKOH/g (preferably 5 to 60 mgKOH/g and more preferably 10 to 50 mgKOH/g), in order to stabilize the chargeability of the toner.

Also the binder resin contains a tetrahydrofuran-insoluble matter by 10 to 30 mass %, for improving the developing property and the high-temperature offset resistance of the toner.

The binder resin to be employed in the present invention preferably has a glass transition temperature (Tg) of 50 to 75° C. A glass transition temperature lower than 50° C. may result in an insufficient storability of the toner, and a glass transition temperature exceeding 75° C. may result in an insufficient fixing property.

The toner of the present invention may contain a wax as a releasing agent.

Examples of the wax to be employed in the present invention include an aliphatic hydrocarbon wax such as low-molecular weight polyethylene, low-molecular weight polypropylene, a polyolefin copolymer, polyolefin wax, microcrystalline wax, paraffin wax, or Fischer-Tropsch wax; an oxide of an alipohatic hydrocarbon wax such as oxidized polyethylene wax; a block copolymer thereof; a vegetable wax such as candelilla wax, carnauba wax, Japan wax or jojoba wax; an animal wax such as bee wax, lanoline, or whale wax; a mineral wax such as ozokerite, ceresine or petrolatum; a wax principally constituted of an aliphatic ester such as montan ester wax or castor wax; and a totally or partially deacidified aliphatic ester such as deacidified carnauba wax. Other examples include a saturated linear aliphatic acid such as palmitic acid, stearic acid, montanic acid or a long-chain alkyl carboxylic acid having an even longer alkyl chain; an unsaturated aliphatic acid such as brassidic acid, eleostearic acid or parinaric acid; a saturated alcohol such as stearyl alcohol, eicosyl alcohol, behenyl alcohl, carnaubyl alcohol, ceryl alcohol, melissyl alcohol or an alkyl alcohol having an even longer alkyl chain; a polyhydric alcohol such as sorbitol; an aliphatic amide such as linolamide, oleylamide, or laurylamide; a saturated aliphatic bisamide such as methylbisstearylamide, ethylenebiscaprylamide, ethylenebislaurylamide or hexamethylenebissgtearylamide; an unsaturated aliphatic acid amide such as ethylenebisoleylamide, hexamethyelenbisoleylamide, N,N'-dioleyladipylamide, or N,N'-dioleylsebacylamide; an aromatic bisamide such as m-xylenebisstearylamide, or N,N'-distearylisophthalylamide; an aliphatic metal salt (so-called metal soap) such as calcium stearate, calcium laurate, zinc stearate or magnesium stearate; a wax formed by grafting a vinyl-type monomer such as styrene or acrylic acid to an aliphatic hydrocarbon wax; a partial ester of an aliphatic acid and a polyhydric alcohol such as behenic acid monoglyceride; and a methyl ester compound having a hydroxyl group, obtained by hydrogenating a vegetable oil or fat.

Also preferably employed is such wax of which molecular weight distribution is made sharper or from which a low-molecular weight solid aliphatic acid, a low-molecular weight solid alcohol, a low-molecular weight solid compound and other impurities are removed by a pressing method, a solvent method, a recrystallization method, a vacuum distillation method, a supercritical gas extraction method or a fused phase crystallization method.

Specific examples of the wax include Viscol (trade name) 330-P, 550-P, 660-P, and TS-200 (Sanyo Chemical Industries); Hi-wax 400P, 200P, 100P, 410P, 420P, 320P, 220P, 210P, and 110P (Mitsui Chemical); Sazol H1, H2, C80, C105, and C77 (Schumann-Sazol), HNP-1, HNP-3, HNP-9, HNP-10, HNP-11 and HNP-12 (Nippon Seiro Co.); Uniline (trade name) 350, 425, 550, 550, Unicid (trade name) 350, 425, 550, and 700 (Toyo Petrorite); Japan wax, bee wax, rice wax, candelilla wax and carnauba wax (available from Ceralica Noda Co.). It is also preferable to add such wax at the manufacture of the resin if necessary, thereby further improving the dispersibility.

The toner of the present invention may further contain a magnetic material for use as a magnetic toner. In such case, the magnetic material may serve also as a colorant.

In the present invention, the magnetic material that can be contained in the magnetic toner can be an iron oxide such as magnetite, maghemite, or ferrite; a metal such as iron, cobalt or nickel; or an alloy of such metal with another metal such as aluminum, cobalt, copper, lead, magnesium, tin, zinc, antimony, beryllium, bismuth, cadmium, calcium, manganese, selenium, titanium, tungsten or vanadium, or a mixture thereof.

Such magnetic material preferably has a number average particle size of 2.0 μm or less, preferably 0.05 to 0.5 μm. A content in the toner is preferably 20 to 200 parts by mass with respect to 100 parts by mass of the binder resin, particularly preferably 40 to 150 parts by mass with respect to 100 parts by mass of the binder resin.

A colorant to be employed in the present invention can be, as a black colorant, carbon black, grafted carbon or a black colorant prepared following yellow/magenta/cyan colorants.

The yellow colorant can be compounds represented by a condensed azo compound, an isoindolinone compound, an anthraquinone compound, an azo metal complex, a methine compound, or an allylamide compound.

The magenta colorant can be a condensed azo compound, a diketopyrrolopyrrole compound, an anthraquinone compound, a quinacridone compound, a basic dye lake, a naphthol compound, a benzimidazolone compound, a thioindigo compound or a perylene compound.

The cyan colorant can be a copper phthalocyanine compound or a derivative thereof, an anthraquinone compund, a basic dye lake. Such colorant may be employed singly, in a mixture or in a solid solution.

The colorant in the present invention is selected in consideration of hue angle, color saturation, lightness value, weathering resistance, transparency on OHP sheet, and dispersibility in the toner. Such colorant is added in an amount of 1 to 20 parts by mass with respect to 100 parts by mass of the binder resin.

The toner of the present invention preferably contains a charge control agent. Following materials are available for obtaining a negative chargeability in the toner.

For example a metalorganic compound or a chelate compound is effective, such as a monoazo metal compound, an acetylacetone metal compound, or a metal compound based on an aromatic hydroxycarboxylic acid or an aromatic dicarboxylic acid. Also an aromatic hydroxycarboxylic acid, an aromatic mono- or poly-carboxylic acid, or a metal salt, anhydride or an ester thereof, or a phenol derivative such as bisphenol is usable.

As a negative chargeable charge control agent, there is preferred an azo metal compound represented by a following general formula (1) or an oxycarboxylic acid metal compound represented by a general formula (2):

(1)

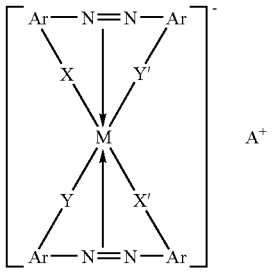

wherein M represents a center metal of coordination such as Sc, Ti, V, Cr, Co, Ni, Mn or Fe; Ar represents an aryl group such as a phenylene group or a naphthylene group which may have a substituent, which can be a nitro group, a halogen atom, a carboxyl group, an anilide group, or an alkyl or alkoxy group having 1 to 18 carbon atoms; X, X', Y, and Y' each represents —O—, —CO—, —NH— or —NR— in which R represents an alkyl group with 1 to 4 carbon atoms; and $A^+$ represents a hydrogen ion, a sodium ion, a potassium ion, an ammonium ion, an aliphatic ammonium ion or a mixture thereof, but $A^+$ may be absent.

Preferably, the center metal is Fe or Cr, and the substituent is a halogen atom, an alkyl group or an anilide group.

(2)

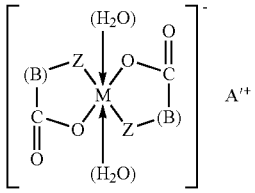

wherein M represents a center metal of coordination such as Cr, Co, Ni, Mn, Fe, Zn, Al, B or Zr; B represents either one of:

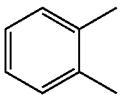

(which may contain a substituent such as an alkyl group),

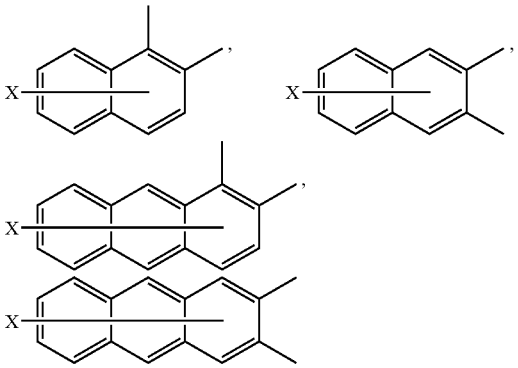

(wherein X represents a hydrogen atom, a halogen atom, a nitro group or an alkyl group), and

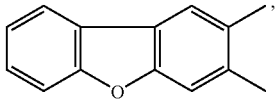

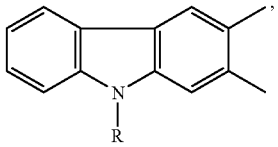

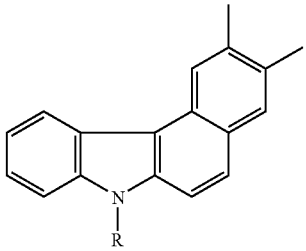

(wherein R represents a hydrogen atom, a $C_1$ to $C_{18}$ alkyl group or a $C_2$ to $C_{18}$ alkenyl group); $A^+$ represents hydrogen, sodium, potassium, ammonium, aliphatic ammonium or being void; and Z represents —O— or —CO—O—.

In particular, the center metal is preferably Fe, Cr, Si, Zn, Zr or Al; the substituent is preferably an alkyl group, an anilide group, an aryl group or a halogen; and the counter ion is preferably a hydrogen ion, an ammonium ion, or an aliphatic ammonium ion.

Among these, an azo metal compound represented by the formula (1) is more preferable, and an azo iron compound represented by a following formula (3) is most preferable.

(3)

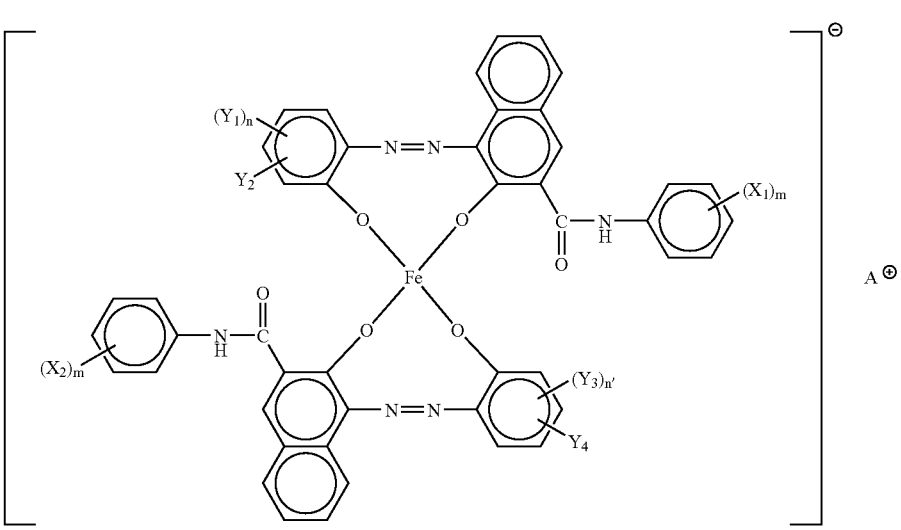

wherein, $X_1$ and $X_2$ each represents a hydrogen atom, a lower alkyl group, a lower alkoxy group, a nitro group or a halogen atom;

m and m' each represents an integer of 1 to 3;

$Y_1$ and $Y_3$ each represents a hydrogen atom, a $C_1$ to $C_{18}$ alkyl group, a $C_2$ to $C_{18}$ alkenyl group, a sulfonamide group, a mesyl group, a sulfonic acid group, a carboxyester group, a hydroxyl group, a $C_1$ to $C_{18}$ alkoxy group, an acetylamino group, a benzoyl group, an amino group or a halogen atom;

n and n' each represents an integer of 1 to 3;

$Y_2$ and $Y_4$ each represents a hydrogen atom or a nitro group ($X_1$ and $X_2$, m and m', $Y_1$ and $Y_3$, n and n', and $Y_2$ and $Y_4$ being mutually same or different); and $A^+$ represents an ammonium ion, an alkali metal ion, a hydrogen ion, or mixed ions thereof.

In the following, specific examples of such compound will be shown.

(1)

azo iron complex compound (1)

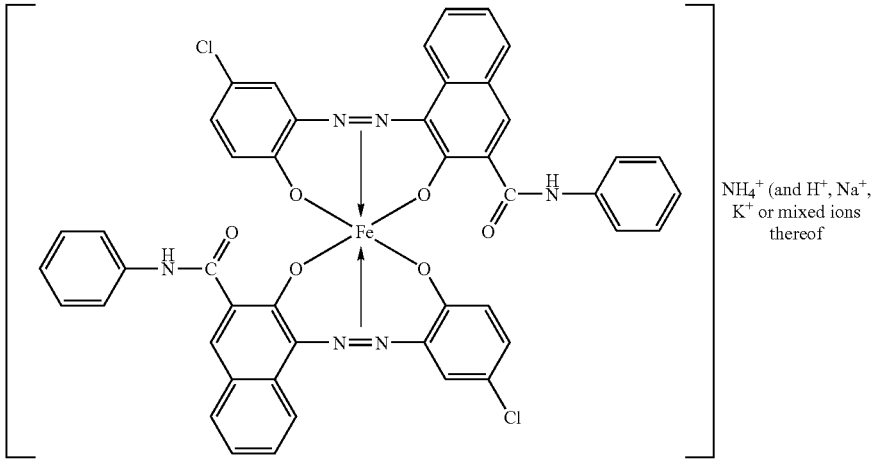

(2)

azo iron complex compound (2)

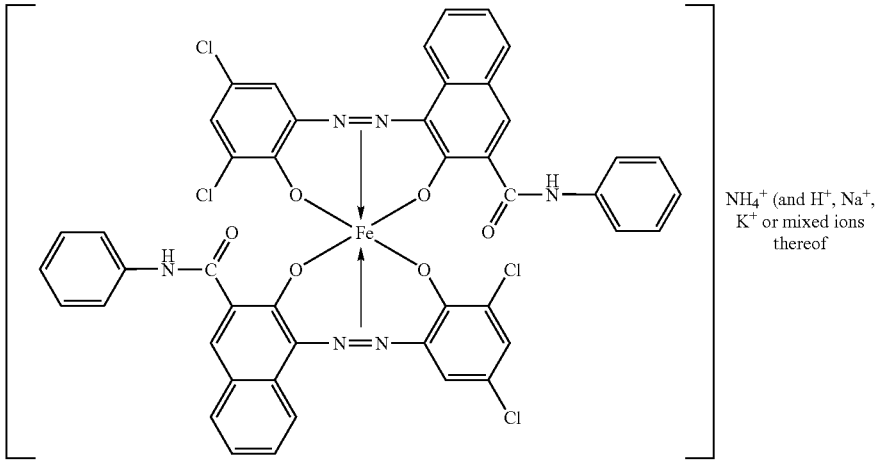

-continued
(3)
azo iron complex compound (3)
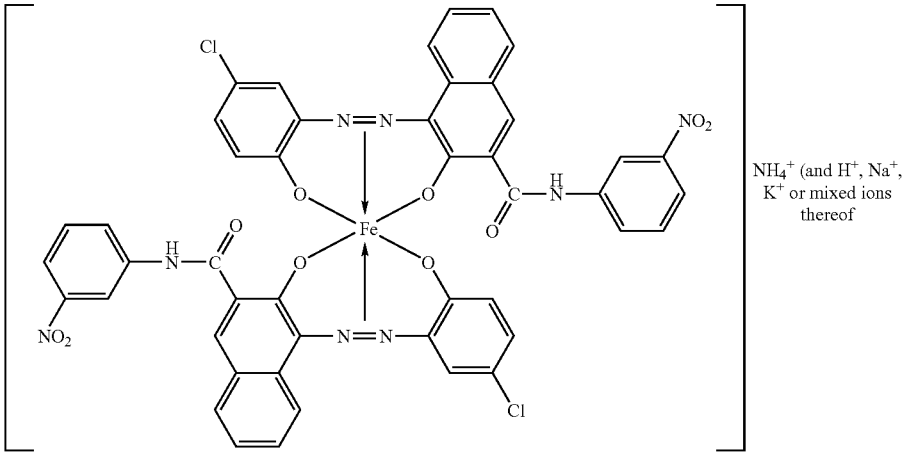
(4)
azo iron complex compound (4)
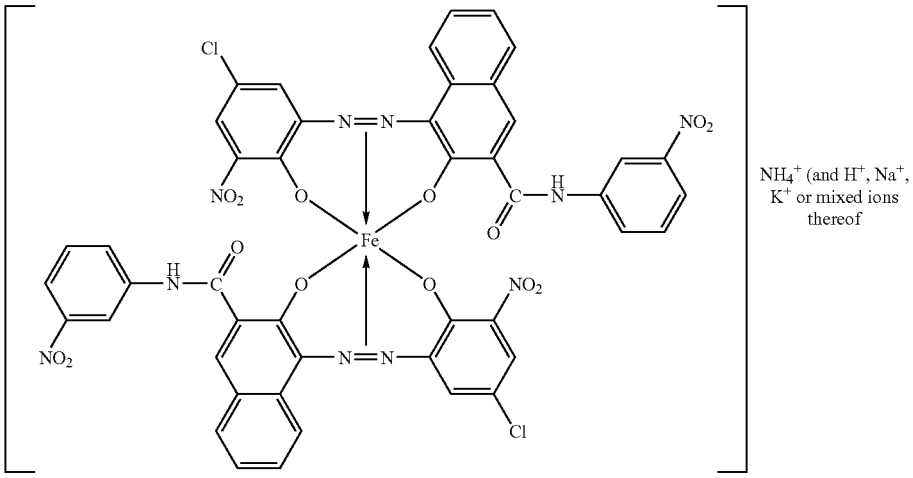
(5)
azo iron complex compound (5)
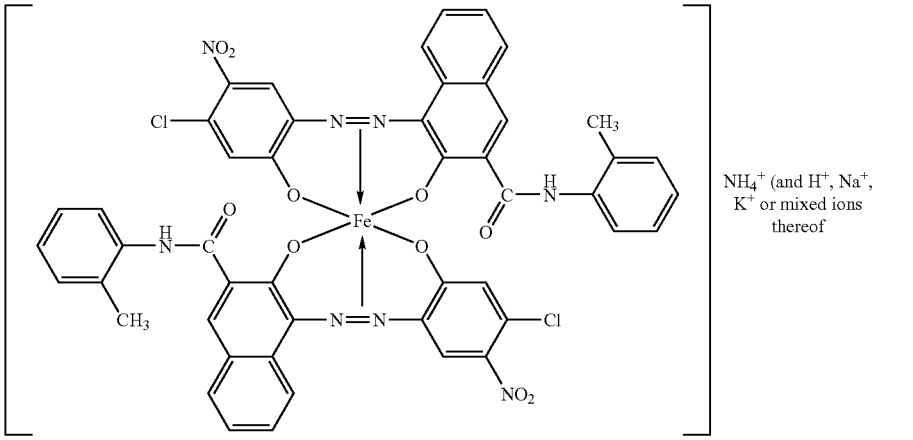

-continued azo iron complex compound (6)

(6)

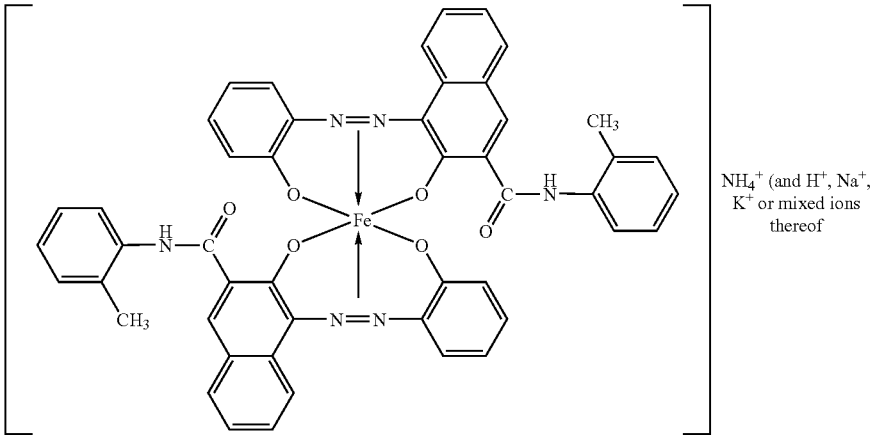

Examples of the positively chargeable charge control agent include: nigrosin and a denatured product thereof with a fatty acid metal salt or the like; a quaternary ammonium salt such as tributylbenzylammonium-1-hydroxy-4-naphthosulfonic acid salt, or tetrabutylammonium tetrafluoroborate, a similar onium salt thereof such as a phosphonium salt and a lake pigment thereof, a triphenylmethane dye and a lake pigment thereof (laking agent being for example phosphotungstic acid, phosphomolybdic acid, phosphotungstenmolybdic acid, tannic acid, lauric acid, gallic acid, ferricyanide, or ferrocyanide), a higher fatty acid metal salt; a diorgano tin oxide such as dibutyl tin oxide, dioctyl tin oxide or dicyclohexyl tin oxide; a diorgano tin borate such as dibutyl tin borate, dioctyl tin borate or dicyclohexyl tin borate; a guanidine compound and an imidazole compound. Such compounds may be employed singly or in a combination of two or more kinds. Among these, particularly preferable is a triphenylmethane compound or a quaternary ammonium salt in which the counter ion is not halogen.

Also a homopolymer of a monomer represented by a general formula (4):

(4)

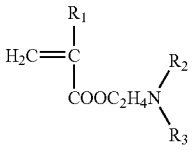

(wherein $R_1$ represents H or $CH_3$; and $R_2$ and $R_3$ each represents a substituted or unsubstituted alkyl group (preferably $C_1$ to $C_4$), or a copolymer thereof with a polymerizable monomer such as styrene, an acrylate ester or a methacrylate ester, may also be employed as the positively chargeable charge control agent. In such case, such charge control agent may function as a binder resin (all or a part thereof).

In the constitution of the present invention, a compound of a following general formula (5) is preferable:

(5)

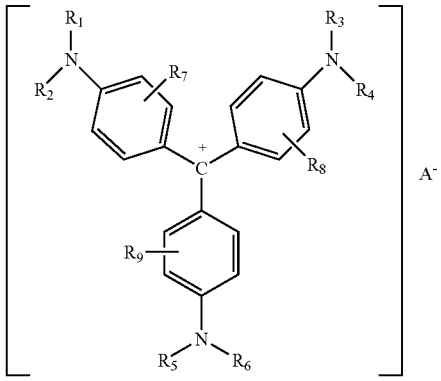

wherein $R_1$, $R_2$, $R_3$, $R_4$, $R_5$ and $R_6$, being mutually same or different, each represents a hydrogen atom, a substituted or unsubstituted alkyl group or a substituted or unsubstituted aryl group; $R_7$, $R_8$ and $R_9$, being mutually same or different, each represents a hydrogen atom, a halogen atom, an alkyl group, or an alkoxy group; and $A^-$ represents an anion selected from a sulfate ion, a nitrate ion, a borate ion, a phosphate ion, a hydroxyl ion, an organosulfate ion, an organosulfonate ion, an organophosphate ion, a carboxylate ion, an organoborate ion and a tetrafluoroborate ion.

Preferred ones for negative charging include, for example, Spilon Black TRH, T-77 and T-95 (Hodogaya Chemical Co.), Bontron (trade name) S-34, S-44, S-54, E-84, E-88 and E-89 (Orient Chemical Co.), and those for positive charging include, for example, TP-302 and TP-415 (Hodogaya Chemical Co.), Bontron (trade name) N-01, N-04, N-07 and P-51 (Orient Chemical Co.), and Copy Blue PR (Clariant Inc.).

The charge control agent may be included in the toner by an internal addition or an external addition. An amount of the charge control agent is determined according to a toner manufacturing method including the type of the binder resin, presence/absence of other additives and a dispersing method and is therefor not uniquely defined, but is preferably within a range of 0.1 to 10 parts by mass with respect to 100 parts by mass of the binder resin, more preferably 0.1 to 5 parts by mass.

The toner of the present invention may also includes a fluidity improving agent. The fluidity improving agent is externally added to the toner particles, and can improve the fluidity thereof by the addition. Examples of such fluidity improving agent include a fluorinated resin powder such as fluorinated vinylidene fine powder, or polytetrafluoroethylene fine powder; powdered silica such as wet process silica or fumed silica, powdered titanium oxide, powdered alumina, a treated powder thereof surface treated with a silane compound, a titanium coupling agent, or silicone oil; an oxide such as zinc oxide or tin oxide; a double oxide such as strontium titanate, barium titanate, calcium titanate, strontium zirconate or calcium zirconate; and a carbonate compound such as calcium carbonate or magnesium carbonate.

A preferred fluidity improving agent is fine powder generated by gaseous phase oxidation of silicon halide, so-called dry process silica or fumed silica. It is for example obtained by a pyrolytic oxidation reaction of silicon tetrachloride gas in an oxyhydrogen flame, according to the following reaction formula:

$$SiCl_4+2H_2+O_2 \rightarrow SiO_2+4HCl$$

In this process, it is also possible to obtain a composite powder of silica and another metal oxide, by utilizing another metal halide such as aluminum chloride or titanium chloride in combination with silicon halide, and such powder is also included in silica. It is preferable to employ silica powder having a particle size, in an average primary particles size, within a range of 0.001 to 2 μm, more preferably 0.002 to 0.2 μm.

Commercial powdered silica, generated by the gas phase oxidation of silicon halide includes, is available for example under trade names: AEROSIL (Nippon Aerosil Co.), 130, 200, 300, 380, TT600, MOX170, MOX800, COK84, Ca-O-Sil (Cabot Co.), M-5, MS-7, MS-75, HS-5, EH-5, Wacker HDK N20 (Wacker-Chemie GmbH), V15, N20E, T30, T40, D-C Fine Silica (Dow-Corning Co.), and Fransol (Fransil Inc.), and these can be employed advantageously in the present invention.

As the fluidity improving agent to be employed in the present invention, more preferred is a treated silica powder, obtained by a hydrophobic treatment on the powdered silica form by the gas phase oxidation of silicon halide. In such treated silica powder, particularly preferred is one obtained by so treating the powdered silica as to have a hydrophobicity, measured by a methanol titration method, within a range of 30 to 80.

The hydrophobic treatment can be a chemical treatment with an organic silicon compound capable of reacting with or physically adsorbing on the powdered silica. In a preferred method, powdered silica generated by gas phase oxidation of silicon halide is treated with an organic silicon compound.

Examples of the organic silicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, βchloroethyltrichlorosilane, chloromethyldimethylchlorosilane, triorganosilylmercaptane, trimethylsilylmercaptane, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, dimethylpolysiloxane having 2 to 12 siloxane units and containing a Si-bonded hydroxyl group in each of terminal units, and silicone oil such as dimethylsilicone oil. There compounds may be employed singly or in a mixture of two or more kinds.

Such fluidity improving agent preferably has a specific surface area, measured by a BET method utilizing nitrogen adsorption, of 30 $m^2/g$ or higher, more preferably 50 $m^2/g$ or higher. The fluidity improving agent is employed in a total amount of 0.01 to 8 parts by mass with respect to 100 parts by mass of the toner particles before external addition, preferably 0.1 to 4 parts by mass.

In the toner of the present invention, in addition to the fluidity improving agent, other external additives (for example charge control agent) may be added if necessary.

The toner of the present invention may be used as a one-component developer, or as a two-component developer in combination with a carrier. The carrier in case of the two-component developer may be any known carrier, but is preferably particles of a metal such as surfacially oxidized or non-oxidized iron, nickel, cobalt, manganese, chromium or a rare earth metal, or an alloy or an oxide thereof with an average particle size of 20 to 300 μm.

It is also preferable to deposit or coat, on the surface of such carrier particles, a resin such as styrene-type resin, an acrylic resin, a silicone resin, a fluorinated resin or a polyester resin.

The toner of the present invention can be produced by sufficiently mixing the binder resin and the colorant, and also the magnetic material, wax, charge control agent and other additives in a mixing machine such as a Henschel mixer or a ball mill, then fusing, mixing and kneading the mixture with a heat mixing machine such as rolls, a kneader or an extruder thereby dispersing wax and magnetic material in the binder resin, and, after solidification by cooling, executing a pulverization and a classification.

The toner of the present invention can be produced by known producing apparatus of which examples are shown in the following.

Examples of the mixer for toner manufacture include Henschel mixer (Mitsui Mining Co.); Super Mixer (Kawata Co.); Ribocone (Okawara Mfg. Co.), Nauter Mixer, Turburizer, Cyclomix (Hosokawa Micron); Spiral Pin Mixer (Taiheiyo Kiko Co.); and Ledige Mixer (Matsubo).

Examples of the kneader include KRC Kneader (Kurimoto Iron Works); Buss-Co-Kneader (Buss Co.); TEM Extruder (Toshiba Machinery); Tex twin-screw kneader (Nippon Steel); PCM kneader (Ikegai Iron Wroks); 3-roll mill, mixing roll mill, kneader (Inoue Mfg.); Kneadex (Mitsui Mining); MS pressurized kneader, kneader-ruder (Moriyama Mfg.); and Bambury mixer (Kobe Steel).

Examples of the pulverizer include Counter Jet Mill, Micron Jet, Inomizer (Hosokawa Micron); IDS mill, PJM jet crusher (Nippon Pneumatic Industry); Cross Jet Mill (Kurimoto Iron Works); Ulmax (Nisso Emngineering); SK Jet-O-Mill (Seishin Kigyo); Cryptron (Kawasaki Heavy Industries); Turbo Mill (Turbo Kogyo); and Super Rotor (Nisshin Engineering).

Examples of the classifier include Classil, Micron Classifier, Spedic Classifier (Seishin Kigyo); Turbo Classifier (Nisshin Engineering); Micron Separator, Turboplex (ATP), TSP Separator (Hosokawa Micron); Elbojet (Nittetsu Kogyo); Dipersion Separator (Nippon Pneumatic Industry); and YM Microcut (Yasukawa Trading).

Examples of the sieving apparatus for separating coarse particles include Ultrasonic (Koei Sangyo Co.); Resonasharp, Gyroshifter (Tokuju Kosakusho); Vibrasonic system (Dalton Inc.); Soniclean (Shinto Kogyo Co.); Turbo Screener (Turbo Kogyo); Microshifter (Makino Sangyo Co.); and a circular vibration sieve.

In the following, measurements of various physical properties on the toner of the present invention will be explained. In the invention, the molecular weight distribution of the THF-soluble matter and the content of the tetrahydrofuran-insoluble matter tetrahydrofuran-insoluble matter in the toner and in the binder resin can be measured by following methods.

(1) Measurement of Molecular Weight of THF-Soluble Matter

The molecular weight by a chromatogram of gel permeation chromatography (GPC) is measured under following conditions.

A column is stabilized in a heat chamber of 40° C. In the column at this temperature, tetrahydrofuran (THF) as a solvent is made to flow at a flow rate of 1 ml/min. For a precise measurement of a molecular weight range of $10^3$ to $2\times10^6$, the column is preferably formed by a combination of plural commercial polystyrene gel columns, such as a combination of Shodex GPC KF-801, 802, 803, 804, 805, 806, 807 and 800P manufactured by Showa Denko Co., or a combination of TSK Gel G1000H($H_{XL}$), G2000H($H_{XL}$), G3000H($H_{XL}$), G4000H ($H_{XL}$), G5000H($H_{XL}$), G6000H($H_{XL}$), G7000H($H_{XL}$) and TSK Guard Column, manufactured by Toso Co, but particularly preferred is a combination of 7 series column of Shodex KF-801, 802, 803, 804, 805, 806 and 807 manufactured by Showa Denko Co.

On the other hand, a toner, a resin or a polyester-type resin component contained in the tetrahydrofuran-insoluble matter of the toner is hydrolyzed, then a vinyl-type resin component obtained as a residual substance is dispersed and dissolved in tetrahydrofuran, then let to stand for 24 hours and filtered with a sample processing filter (pore size: 0.2 to 0.5 μm, for example My-Shori disk H-25-2, manufactured by Toso Co.) to obtain a filtrate which is used as a sample. Measurement is executed by injecting 50 to 200 μl of a THF solution of toner, so prepared as to have a concentration of the resin component of 0.5 to 5 mg/ml. An RI (refractive index) detector is employed for the measurement.

In the molecular weight measurement of the sample, the distribution of the sample is calculated from a calibration line, prepared by several monodispersed polystyrene standard samples and indicating a logarithmic value-count relationship. As the standard polystyrene samples for preparing the calibration line, it is desirable to use at least about 10 standard samples, for example having molecular weights of $6.0\times10^2$, $2.1\times10^3$, $4\times10^3$, $1.75\times10^4$, $5.1\times10^4$, $1.1\times10^5$, $3.9\times10^5$, $8.6\times10^5$, $2.0\times10^6$, and $4.48\times10^6$, as manufactured by Pressure Chemical Co. or by Toyo Soda Industries Ltd.

(2) Amount of Tetrahydrofuran-Insoluble Matter

A binder resin or a toner is weighed, then is charged in a cylindrical filter paper (such as No. 86R of a size of 28 mm×10 mm, manufactured by Toyo Filter Paper Co.) and placed in a Soxhlet's extractor. 200 ml of tetrahydrofuran are employed as the solvent to execute extraction for 16 hours. The extraction is conducted with such a refluxing rate that an extraction cycle with tetrahydrofuran is executed every 4 to 5 minutes. After the extraction, the cylindrical filter paper is taken out, and weighed to obtain the insoluble matter of the binder resin or the toner.

In case the toner contains a tetrahydrofuran-insoluble matter other than the resin component, such as a magnetic material, a pigment, a wax or a charge control agent, the content of the tetrahydrofuran-insoluble matter of the resin component in the toner can be obtained by a following equation:

$$\text{Tetrahydrofuran-insoluble matter (mass \%)}=[\{W_1-(W_3+W_2)\}/(W_1-W_3)]\times100$$

wherein $W_1$ (g) is a mass of the toner charged in the cylindrical filter paper, $W_2$ (g) is a mass of the extracted THF-soluble resin component, and $W_3$ (g) is a mass of the tetrahydrofuran-insoluble matter other than the resin component, contained in the toner.

(3) Measuring Method for Acid Value of Resin

The acid value of the binder resin of the invention can be measured by a following method. The basic procedure is according to JIS K0070.

1) A pulverized binder resin of 0.5 to 2.0 g is precisely weighed to obtain a weight W (g) of the binder resin.
2) The sample is placed in a 300-ml beaker and dissolved by adding 150 ml of a toluene/ethanol (4/1) mixture.
3) A titration is executed with a 0.1 mol/L KOH solution in methanol, utilizing a potentiometric titration apparatus (for example by an automatic titration with a potentiometric titration apparatus AT-400 (Win Workstation) and an electric bullet ABP-410, manufactured by Kyoto Electronic Co.).
4) Thus, there are obtained a used amount S (ml) of the KOH solution and a used amount B (ml) of the KOH solution in a blank measurement conducted at the same time.
5) An acid value of the binder resin is calculated by the following formula, in which f is a factor for KOH:

$$\text{Acid value (mgKOH/g)}=((S-B)\times f\times5.61)/W.$$

(4) Measuring Method for Hydroxyl Value of Resin

The hydroxyl value of the binder resin of the invention can be measured by a following method.

(A) Reagents (a) Acetylation Reagent:

25 g of acetic anhydride are placed in a 100-ml measuring flask, and pyridine is added to a total amount of 100 ml and the mixture is sufficiently mixed by shaking. The acetylation reagent is kept from moisture, carbon dioxide gas and acid vapor, and is stored in a brown-colored bottle.

(b) Phenolphthalein Solution 1 g of phenolphthalein is dissolved in 100 ml of ethyl alcohol (95 vol %).

(c) 0.5 mol/L Potassium Hydroxide Solution in Ethyl Alcohol 35 g of potassium hydroxide are dissolved in water of an amount as small as possible, then ethyl alcohol (95 vol %) is added to a total volume of 1 L, and the obtained solution is filtered after standing for 2 to 3 days. A standardization is executed according to JIS K8006.

(B) Operation

A sample of 0.5 to 2.0 g is precisely weighed and placed in a round-bottom flask, and 5 ml of the acetylation reagent are precisely added. The flask is covered by a small funnel placed over the opening of the flask, and is heated by immersing about 1 cm of the flask bottom in a glycerin bath of 95 to 100° C. In order to prevent the flask neck from being heated by the bath, a disk-shaped cardboard, having a round hole, is placed at the base part of the flask neck. The flask is taken out from the bath after 1 hour, and after spontaneous cooling, 1 ml of water is added from the funnel and the mixture is shaken to decompose acetic anhydride. The flask is heated again for 10 minutes on the glycerin bath for completing the decomposition, then, after spontaneous cooling, the funnel and the flask neck are washed with 5 ml of ethyl alcohol, and a titration is conducted with the 0.5 mol/L potassium hydroxide solution in ethyl alcohol, utilizing the phenolphthalein solution as an indicator. An end point is taken when the pale pink color of the indicator lasted for 30 seconds. Also a blank test is conducted in parallel.

(C) Calculation Formula

The hydroxyl value of the binder resin is calculated by the following formula:

$$A=[\{(B+C)\times f\times 28.05\}/S]+D$$

wherein:

A: hydroxyl value of resin

B: used amount (ml) of 0.5 mol/L potassium hydroxide solution in ethyl alcohol in blank test C: used amount (ml) of 0.5 mol/L potassium hydroxide solution in ethyl alcohol in main test f: factor for 0.5 mol/L potassium hydroxide solution in ethyl alcohol S: sample mass (g)

D: acid value of sample.

(5) GPC-RALLS Viscosimeter Analysis (i) Pre-Treatment 0.1 g of toner are placed in a 20-ml test tube together with 10 ml of THF, and dissolved for 24 hours at 25° C. Then it is filtered with a sample processing filter (pore size: 0.2 to 0.5 μm, for example My-Shori disk H-25-2, manufactured by Toso Co.) to obtain a filtrate which is used as a GPC sample.

(ii) Analysis Conditions

Apparatus:

HLC-8120GPC (manufactured by Toso);

DAWN EOS (manufactured by Wyatt Technology Inc.)

High-temperature differential pressure viscosity detector (manufactured by Viscotek Inc.)

Column:

a 4-column combination of KF-807, 806M, 805 and 803 (manufactured by Showa Denko Co.)

Detector 1:

multi-angle light scattering detector Wyatt

DAWN EOS

Detector 2:

high-temperature differential pressure viscosity detector

Detector 3:

Brice differential refractometer

Temperature: 40° C.

Solvent: THF

Flow rate: 1.0 ml/min

Injection amount: 400 μl.

This measurement directly provides a molecular weight distribution based on the absolute molecular weight, an inertial square radius and an intrinsic viscosity, based on following measuring theory.

(Measuring Theory)

M90=R(θ90)/KC Rayleigh equation

M90: molecular weight at 90°

R(θ90): Rayleight ratio at a scattering angle 90°

K: optical constant ($=2\Pi^2n^2/\lambda_0^4N_A\cdot(dn/dc)^2$)

C: solution concentration

Rg: $=(1/6)^{1/2}([\eta]M90/\Phi)^{1/3}$ Flory Fox equation

Rg: inertial radius

η: intrinsic viscosity

Φ: shape factor absolute molecular weight: M=R(θ0)/KC

R(θ0)=R(θ90)/P(θ90)

$P(\theta 90)=2/X^2\cdot(e^{-x}-(1-X))$ $(X=4\Pi n/\lambda\cdot Rg)$

λ: wavelength (dn/dc): 0.089 ml/g for a hybrid resin-containing toner, 0.078 ml/g for a toner containing polyester resin only, and 0.185 ml/g for a linear polystyrene.

EXAMPLES

In the following, the present invention will be clarified further by examples, but the present invention is not at all limited by such examples.

(Production Example of Binder Resin)

Polyester Resin Production Example 1

Polyester monomers were mixed with a following ratio:

| | |
|---|---|
| bisphenol derivative represented by formula (A) (R: propylene group, average of x + y: 2.2) | 1.150 mol |
| terephthalic acid | 0.430 mol |
| isophthalic acid | 0.390 mol |
| fumaric acid | 0.010 mol |
| dodecenylsuccinic anhydride | 0.170 mol |

These were added with tetrabutyl titanate by 0.1 mass % as a catalyst, and were subjected to a polycondensation at 220° C. to obtain an unsaturated polyester resin P-1 (Tg=58° C., main peak molecular weight=7800, number-average molecular weight (Mn)=4600, Mw/Mn=2.1, acid value=5 mgKOH/g, hydroxyl value=37 mgKOH/g).

Polyester Resin Production Example 2

A procedure was conducted in the same manner as in Polyester Resin Production Example 1, except for mixing the polyester monomers in a following ratio, to obtain an unsaturated polyester resin P-2 (Tg=59° C., main peak molecular weight=6400, number–average molecular weight (Mn) =3900, Mw/Mn=2.8, acid value=11 mgKOH/g, hydroxyl value=56 mgKOH/g):

| | |
|---|---|
| bisphenol derivative represented by formula (A) (R: propylene group, average of x + y: 2.2) | 1.150 mol |
| terephthalic acid | 0.430 mol |
| isophthalic acid | 0.370 mol |
| fumaric acid | 0.040 mol |
| dodecenylsuccinic anhydride | 0.160 mol. |

Polyester Resin Production Example 3

A procedure was conducted in the same manner as in Polyester Resin Production Example 1, except for mixing the polyester monomers in a following ratio, to obtain an unsaturated polyester resin P-3 (Tg=55° C., main peak molecular weight=4900, number–average molecular weight (Mn) =3100, Mw/Mn=3.7, acid value=17 mgKOH/g, hydroxyl value=57 mgKOH/g):

| | |
|---|---|
| bisphenol derivative represented by formula (A) (R: propylene group, average of x + y: 2.2) | 1.100 mol |
| terephthalic acid | 0.420 mol |
| isophthalic acid | 0.380 mol |
| fumaric acid | 0.040 mol |
| dodecenylsuccinic anhydride | 0.160 mol. |

Polyester Resin Production Example 4

A procedure was conducted in the same manner as in Polyester Resin Production Example 1, except for mixing the polyester monomers in a following ratio, to obtain an unsaturated polyester resin P-4 (Tg=60° C., main peak molecular weight=4500, number–average molecular weight (Mn) =2900, Mw/Mn=5.4, acid value=27 mgKOH/g, hydroxyl value=69 mgKOH/g):

| | |
|---|---|
| bisphenol derivative represented by formula (A) (R: propylene group, average of x + y: 2.2) | 1.150 mol |
| terephthalic acid | 0.370 mol |
| isophthalic acid | 0.290 mol |
| fumaric acid | 0.080 mol |
| dodecenylsuccinic anhydride | 0.200 mol |
| trimellitic acid | 0.060 mol |

Polyester Resin Production Example 5

A procedure was conducted in the same manner as in Polyester Resin Production Example 1, except for mixing the polyester monomers in a following ratio, to obtain a saturated polyester resin P-5 (Tg=56° C., main peak molecular weight=7500, number–average molecular weight (Mn) =5100, Mw/Mn=2.4, acid value=5 mgKOH/g, hydroxyl value=41 mgKOH/g):

| | |
|---|---|
| bisphenol derivative represented by formula (A) (R: propylene group, average of x + y: 2.2) | 1.150 mol |
| terephthalic acid | 0.430 mol |
| isophthalic acid | 0.400 mol |
| dodecenylsuccinic anhydride | 0.170 mol. |

Polyester Resin Production Example 6

A procedure was conducted in the same manner as in Polyester Resin Production Example 1, except for mixing the polyester monomers in a following ratio, to obtain a saturated polyester resin P-6 (Tg=56° C., main peak molecular weight=6800, number–average molecular weight (Mn) =3800, Mw/Mn=18.4, acid value=2 mgKOH/g, hydroxyl value=25 mgKOH/g):

| | |
|---|---|
| bisphenol derivative represented by formula (A) (R: propylene group, average of x + y: 2.2) | 1.200 mol |
| terephthalic acid | 0.400 mol |
| isophthalic acid | 0.100 mol |
| dodecenylsuccinic anhydride | 0.500 mol |
| trimellitic anhydride | 0.100 mol |

Hybrid Resin Production Example 1

75 parts by mass of the unsaturated polyester resin P-1; 18 parts by mass of styrene, 6.5 parts by mass of n-butyl acrylate and 0.5 parts by mass of mono-n-butyl maleate as vinyl-type monomers; and 0.08 parts by mass of 2,5-dimethyl-2,5-bis(t-butylperoxy)hexine-3 (10-hour half-life temperature: 128° C.) as an initiator were mixed. This vinyl-type monomers/polyester resin mixture was polymerized at 120° C. for 20 hours until the vinyl-type monomer reached a polymerization conversion rate of 97%, and was further heated to and maintained at 150° C. for 5 hours to polymerize the unreacted vinyl-type monomers, thereby obtaining a hybrid resin, as a binder resin 1. Thus obtained binder resin 1 showed, in a GPC-measured molecular weight distribution of the THF-soluble matter, a main peak molecular weight of 7200 and components in a molecular weight range of 40,000 to 1,000,000 by 8 mass %, and contained 21 mass % of a tetrahydrofuran-insoluble matter. The tetrahydrofuran-soluble matter which is the component obtained by hydrolyzing a tetrahydrofuran-insoluble matter, fitration and filtering off was analysed, and the tetrahydrofuran-soluble matter contained a vinyl-type resin. Generally, in the case of not-containing hybrid resin, THF-soluble matter is not produced by hydrolysis. Thus, in this example it was confirmed that the hybrid resin is contained in the tetrahydrofuran-insoluble matter.

Hybrid Resin Production Example 2

70 parts by mass of the unsaturated polyester resin P-2; 23 parts by mass of styrene, 6.0 parts by mass of n-butyl acrylate and 1.0 part by mass of mono-n-butyl maleate as vinyl-type monomers; and 0.08 parts by mass of 2,5-dimethyl-2,5-bis(t-butylperoxy)hexine-3 as an initiator were mixed. This vinyl-type monomers/polyester resin mixture was polymerized at 115° C. for 15 hours until the vinyl-type monomer reached a polymerization conversion rate of 84%, and was further heated to and maintained at 150° C. for 5 hours to polymerize the unreacted vinyl-type monomers, thereby obtaining a hybrid resin, as a binder resin 2. Thus obtained binder resin 2 showed, in a GPC-measured molecular weight distribution of the THF-soluble matter, a main peak molecular weight of 6600 and components in a molecular weight range of 40,000 to 1,000,000 by 22 masse, and contained 26 mass % of a tetrahydrofuran-insoluble matter. The component obtained by hydrolyzing a tetrahydrofuran-insoluble matter, fitration and filtering off was analysed, and the component contained a vinyl-type resin. Thus, in this example it was confirmed that the hybrid resin is contained in the tetrahydrofuran-insoluble matter.

Hybrid Resin Production Example 3

70 parts by mass of the unsaturated polyester resin P-2; 23 parts by mass of styrene, 6.0 parts by mass of n-butyl acrylate and 1.0 part by mass of mono-n-butyl maleate as vinyl-type monomers; and 0.15 parts by mass of 2,5-dimethyl-2,5-bis(t-butylperoxy)hexine-3 as an initiator were mixed. This vinyl-type monomers/polyester resin mixture was polymerized at 110° C. for 15 hours until the vinyl-type monomer reached a polymerization conversion rate of 71%, and was further heated to and maintained at 160° C. for 5 hours to polymerize the unreacted vinyl-type monomers, thereby obtaining a hybrid resin, as a binder resin 3. Thus obtained binder resin 3 showed, in a GPC-measured molecular weight distribution of the THF-soluble matter, a main peak molecular weight of 6700 and components in a molecular weight range of 40,000 to 1,000,000 by 23 mass %, and contained 13 mass % of a tetrahydrofuran-insoluble matter. The component obtained by hydrolyzing a tetrahydrofuran-insoluble matter, fitration and filtering off was analysed, and the component contained a vinyl-type resin. Thus, in this example it was confirmed that the hybrid resin is contained in the tetrahydrofuran-insoluble matter.

Hybrid Resin Production Example 4

80 parts by mass of the unsaturated polyester resin P-3; 14 parts by mass of styrene and 6.0 parts by mass of n-butyl acrylate as vinyl-type monomers; and 0.05 parts by mass of 2,5-dimethyl-2,5-bis(t-butylperoxy)hexine-3 as an initiator were mixed. This vinyl-type monomers/polyester resin mixture was polymerized at 110° C. for 10 hours until the vinyl-type monomer reached a polymerization conversion rate of 63%, and was further heated to and maintained at 150° C. for 10 hours to polymerize the unreacted vinyl-type monomers, thereby obtaining a hybrid resin, as a binder resin 4. Thus obtained binder resin 4 showed, in a GPC-measured molecular weight distribution of the THF-soluble matter, a main peak molecular weight of 4800 and components in a molecular weight range of 40,000 to 1,000,000 by 26 mass %, and contained 8 mass % of a tetrahydrofuran-insoluble matter. The component obtained by hydrolyzing a tetrahydrofuran-insoluble matter, fitration and filtering off was analysed, and the component contained a vinyl-type resin. Thus, in this example it was confirmed that the hybrid resin is contained in the tetrahydrofuran-insoluble matter.

Hybrid Resin Production Example 5

55 parts by mass of the unsaturated polyester resin P-4; 30 parts by mass of styrene and 15 parts by mass of n-butyl acrylate as vinyl-type monomers; and 0.15 parts by mass of 2,5-dimethyl-2,5-bis(t-butylperoxy)hexine-3 as an initiator were mixed. This vinyl-type monomers/polyester resin mixture was polymerized at 110° C. for 10 hours until the vinyl-type monomer reached a polymerization conversion rate of 57%, and was further heated to and maintained at 150° C. for 10 hours to polymerize the unreacted vinyl-type monomers, thereby obtaining a hybrid resin, as a binder resin 5. Thus obtained binder resin 5 showed, in a GPC-measured molecular weight distribution of the THF-soluble matter, a main peak molecular weight of 4300 and components in a molecular weight range of 40,000 to 1,000,000 by 37 mass %, and contained 41 mass % of a tetrahydrofuran-insoluble matter. The component obtained by hydrolyzing a tetrahydrofuran-insoluble matter, fitration and filtering off was analysed, and the component contained a vinyl-type resin. Thus, in this example it was confirmed that the hybrid resin is contained in the tetrahydrofuran-insoluble matter.

Hybrid Resin Production Example 6

55 parts by mass of the unsaturated polyester resin P-4; 30 parts by mass of styrene, 14.9 parts by mass of n-butyl acrylate and 0.1 parts by mass of divinylbenzene as vinyl-type monomers; and 0.15 parts by mass of 2,5-dimethyl-2,5-bis(t-butylperoxy)hexine-3 as an initiator were mixed. This vinyl-type monomers/polyester resin mixture was polymerized at 110° C. for 10 hours until the vinyl-type monomer reached a polymerization conversion rate of 53%, and was further heated to and maintained at 150° C. for 10 hours to polymerize the unreacted vinyl-type monomers, thereby obtaining a hybrid resin, as a binder resin 6. Thus obtained binder resin 6 showed, in a GPC-measured molecular weight distribution of the THF-soluble matter, a main peak molecular weight of 4200 and components in a molecular weight range of 40,000 to 1,000,000 by 44 mass %, and contained 47 mass % of a tetrahydrofuran-insoluble matter. The component obtained by hydrolyzing a tetrahydrofuran-insoluble matter, fitration and filtering off was analysed, and the component contained a vinyl-type resin. Thus, in this example it was confirmed that the hybrid resin is contained in the tetrahydrofuran-insoluble matter.

Comparative Resin Production Example 1

75 parts by mass of the saturated polyester resin P-5; 18 parts by mass of styrene and 7 parts by mass of n-butyl acrylate as vinyl-type monomers; and 0.08 parts by mass of 2,5-dimethyl-2,5-bis(t-butylperoxy)hexine-3 as an initiator were mixed. This vinyl-type monomers/polyester resin mixture was polymerized at 120° C. for 20 hours until the vinyl-type monomer reached a polymerization conversion rate of 94%, and was further heated to and maintained at 150° C. for 5 hours to polymerize the unreacted vinyl-type monomers, thereby obtaining a comparative binder resin 1. Thus obtained comparative binder resin 1 showed, in a GPC-measured molecular weight distribution of the THF-soluble matter, a main peak molecular weight of 7500 and components in a molecular weight range of 40,000 to 1,000,000 by 28 mass %, and did not contain a tetrahydrofuran-insoluble matter.

Comparative Hybrid Resin Production Example 2

270 g of styrene, 60 g of 2-ethylhexyl acrylate and 20 g of acrylic acid as vinyl-type monomers and 13 g of azobisisobutyronitrile as an initiator were charged in a dropping funnel.

780 g (2.23 mol) of polyoxypropylene(2,2)-2,2-bis(4-hydroxyphenyl)propane, 76 g (0.28 mol) of isododecenylsuccinic anhydride, 180 g (1.09 mol) of terephthalic acid, 30 g (0.16 mol) of 1,2,4-benzenetricarboxylic acid, and 2 g (8.0 mmol) of dibutyl tin oxide were charged in a flask, and, under agitation at 135° C., the vinyl-type monomers and the initiator were dropwise added from the dropping funnel over 3 hours to execute polymerization of vinyl-type resin component. The mixture was subjected to a ripening for 5 hours at 135° C., and was then heated to 230° C. to polymerize the polyester resin component, thereby obtaining a hybrid resin as a comparative binder resin 2. Thus obtained comparative binder resin 2 showed, in a GPC-measured molecular weight distribution of the THF-soluble matter, a main peak molecular weight of 6400 and components in a molecular weight range of 40,000 to 1,000,000 by 24 mass %, and contained 14 mass % of a tetrahydrofuran-insoluble matter. The component obtained by hydrolyzing a tetrahydrofuran-insoluble matter, fitration and filtering off was analysed, and the component contained a vinyl-type resin. Thus, in this example it was confirmed that the hybrid resin is contained in the tetrahydrofuran-insoluble matter.

Comparative Hybrid Resin Production Example 3

300 parts by mass of xylene were heated and refluxed, and, under refluxing, a mixture of 70 parts by mass of styrene, 21 parts by mass of n-butyl acrylate, 7 parts by mass of mono-n-butyl maleate and 3 parts by mass of di-tert-butylperoxide was dropwise added over 4 hours, and the reaction mixture was retained for 2 hours to complete the polymerization. Xylene was distilled off to obtain a vinyl-type resin V-1 (Tg=58° C., main peak molecular weight=12400, number-average molecular weight (Mn)=6200, Mw/Mn=3.4, acid value=21 mgKOH/g).

80 parts by mass of the saturated polyester resin P-6; and 20 parts by mass of the vinyl-type resin V-1 were charged in a reaction tank, and the polyester resin and the vinyl-type resin were melt mixed at 190° C. under a nitrogen flow, and, after sufficient mixing, were subjected to an esterification reaction to obtain a hybrid resin, as a comparative binder resin 3. Thus obtained comparative binder resin 3 showed, in a GPC-measured molecular weight distribution of the THF-soluble matter, a main peak molecular weight of 7000 and components in a molecular weight range of 40,000 to 1,000,000 by 36 mass %, and contained 44 mass % of a tetrahydrofuran-insoluble matter. The component obtained by hydrolyzing a tetrahydrofuran-insoluble matter, fitration and filtering off was analysed, and the component contained a vinyl-type resin. Thus, in this example it was confirmed that the hybrid resin is contained in the tetrahydrofuran-insoluble matter.

Example 1

Following materials:

| | |
|---|---|
| binder resin 1 | 100 parts by mass |
| magnetite (average particle size: 0.18 μm) | 100 parts by mass |
| azo iron complex compound (1) (counter ion: $NH_4^+$) | 2 parts by mass |
| Fischer-Tropsch wax (Mn: 790, Mw: 1170, main peak molecular weight: 960, DSC peak temperature: 103° C.) | 4 parts by mass |

were preliminarily mixed in a Henschel mixer, and were kneaded by a two-screw kneader-extruder (PCM-30, manufactured by Ikegai Iron Works) set at 130° C., 200 rpm. The obtained kneaded substance was cooled, then rough crushed by a cutter mill, further fine pulverized with a pulverizer utilizing a jet stream, and classified by a multi-division classifier utilizing Coanda effect to obtain magnetic material-containing resin particles of negative chargeability with a weight-average diameter (D4) of 6.0 μm. 1.0 part by mass of hexamethyldisilazane-treated negatively chargeable hydrophobic silica (BET specific surface area: 120 $m^2/g$) was externally added by a Henschel mixer to 100 parts by mass of the resin particles to obtain a toner 1. Physical properties of the toner 1 are shown in Table 1. This toner was evaluated on following items, and results of evaluation are shown in Table 2.

(Fixing Test)

There was employed an external fixing device, which was prepared by taking out a fixing device from a Hewlett Packard laser beam printer: Laser Jet 4350, and so modifying it as to have an arbitrarily settable fixing temperature and a process speed of 400 mm/sec. This external fixing device was controlled at temperatures with an interval of 5° C. from 140° C., within a range of 140 to 220° C., and used for fixing an unfixed solid black image (toner amount set at 0.6 $mg/cm^2$) formed on a plain paper (75 $g/m^2$). The obtained fixed image was rubbed with a Silbon paper (lens-cleaning paper), loaded with a weight of 4.9 kPa, by five reciprocating cycles, and a temperature at which the image density decrease rate before and after the rubbing became 10% or less was taken a fixing temperature. A lower temperature indicates a better low-temperature fixing property of the toner.

Also fixation of the unfixed image was conducted by setting the process speed at 100 mm/sec and controlling the temperature at an interval of 5° C. from 200° C. within a temperature range of 200 to 240° C. A stain caused by an offset phenomenon on the fixed image was visually observed, and a temperature at which the stain appeared was taken as a high-temperature offset resistance. A higher temperature indicates a better high-temperature offset resistance of the toner.

(Developing Test)

A commercial laser beam printer Laser Jet 4350 (manufactured by Hewlett Packard) was modified to 65 prints per minute, and an image reproduction test was conducted with an A4-sized transfer sheet of 75 $g/m^2$ in an environment of normal temperature and normal humidity (23° C., 60% RH). The employed image data were data of an original having an image area ratio of 2%. Under these conditions, a solid-black image density and a fog were measured at 1,000-th sheet and 20,000-th sheet.

The image density was measured by a reflective density measured by a Mcbeth densitometer (manufactured by Mcbeth Inc.) with an SPI filter, and was averaged over 5 points.

The fog was calculated from a difference between a whiteness of the transfer sheet measured with a reflectometer (manufactured by Tokyo Denshoku Co.) and a whiteness of the transfer sheet after printing a solid white image.

(Storability Test)

10 g of toner were weighed in a cylindrical polypropylene cup having 3 cm in a diameter, the surface was flattened and a paraffin paper was placed on the flattened surface. Then 10 g of iron powder carrier were placed thereon and let to stand for 5 days at 50° C., and a blocking state of the toner was evaluated as follows:

A: when the cup is inclined, toner flows freely;

B: when the cup is rotated, toner disintegrates from the surface and becomes freely flowable powder;

C: when the cup is rotated and given a force from the outside, toner disintegrates from the surface and gradually becomes freely flowable;

D: blocking clot is generated, which is disintegrated when pricked with a sharp object;

E: blocking clot is generated, which is not easily disintegrated by pricking.

Examples 2 to 6 and Comparative Examples 1 to 3

Toners 2 to 9 were obtained in the same manner as in Example 1, except for respectively employing binder resins 2 to 6 and comparative binder resins 1 to 3 instead of using binder resin 1. Physical properties of the toners 2 to 9 are shown in Table 1. Also evaluations were made in the same manner as in Example 1, and results are shown in Table 2.

TABLE 1

| | Binder resin No. | polyester resin component/ vinyl-type resin component (mass ratio) | molecular weight of THF-soluble matter main peak molecular weight | molecular weight of THF-soluble matter proportion of molec. wt. 40,000-1,000,000 (mass %) | THF-insoluble matter Content (mass %) | THF-insoluble matter Content of Vinyl type resin component in THF-insoluble matter (mass %) | THF-insoluble matter main peak molec. wt. of hydrolysis residual substance | analysis by GPC-RALLs viscosimeter inertial square radius of component of absolute molec. wt. of $5.0 \times 10^5$ (nm) | analysis by GPC-RALLs viscosimeter inertial square radius of component of absolute molec. wt. of $1.0 \times 10^7$ (nm) | analysis by GPC-RALLs viscosimeter inertial square radius of component of absolute molec. wt. of $2.0 \times 10^6$ (nm) | $k_L/k_H$ |
|---|---|---|---|---|---|---|---|---|---|---|---|
| Toner 1 | Binder resin 1 | 75/25 | 7000 | 13 | 19 | 63 | 153,000 | 15.4 | 69.4 | 31.9 | 1.1 |
| Toner 2 | Binder resin 2 | 70/30 | 6500 | 23 | 23 | 78 | 269,000 | 17.2 | 76.9 | 33.5 | 0.9 |
| Toner 3 | Binder resin 3 | 70/30 | 6700 | 24 | 10 | 41 | 64,000 | 8.9 | 53.9 | 20.2 | 1 |
| Toner 4 | Binder resin 4 | 80/20 | 4800 | 29 | 7 | 55 | 52,000 | 7.1 | 84.3 | 17.7 | 0.7 |
| Toner 5 | Binder resin 5 | 55/45 | 4100 | 42 | 11 | 72 | 87,000 | 7.7 | 92.5 | 18.4 | 0.6 |
| Toner 6 | Binder resin 6 | 55/45 | 3900 | 39 | 6 | 84 | 93,000 | 6.4 | 38.1 | 12.9 | 0.7 |
| Toner 7 | comparative binder resin 1 | 75/25 | 7500 | 28 | 0 | — | — | 12.3 | — | — | — |
| Toner 8 | comparative binder resin 2 | 75/25 | 6300 | 33 | 2 | 64 | 8,000 | 34.6 | 48.4 | 41.1 | 1.3 |
| Toner 9 | comparative binder resin 3 | 80/20 | 6900 | 41 | 34 | 33 | 13,000 | 40.3 | 53.5 | 44.6 | 0.6 |

TABLE 2

| | low-temp. fixing property (° C.) | high-temp. offset property (° C.) | image density 1,000-th sheet | image density 20,000-th sheet | fog (%) 1,000-th sheet | fog (%) 20,000-th sheet | Storability |
|---|---|---|---|---|---|---|---|
| Example 1 | 155 | no offset at 240° C. | 1.51 | 1.47 | 0.3 | 0.6 | A |
| Example 2 | 160 | no offset at 240° C. | 1.48 | 1.44 | 0.7 | 1.3 | A |
| Example 3 | 165 | 230 | 1.43 | 1.40 | 0.9 | 2.1 | A |
| Example 4 | 175 | 225 | 1.39 | 1.33 | 1.5 | 2.7 | B |
| Example 5 | 185 | 220 | 1.34 | 1.31 | 2.9 | 3.6 | C |
| Example 6 | 195 | 210 | 1.27 | 1.14 | 3.3 | 4.4 | D |
| Comp. Ex. 1 | 180 | 190 | 1.11 | 0.77 | 5.9 | 8.6 | E |
| Comp. Ex. 2 | 205 | 205 | 1.15 | 1.02 | 2.8 | 5.1 | B |
| Comp. Ex. 3 | 220 | 230 | 1.02 | 0.64 | 8.7 | 10.5 | D |

This application claims priority from Japanese Patent Application Nos. 2005-124977 filed Apr. 22, 2005, and 2006-083544 filed Mar. 24, 2006, which are hereby incorporated by reference herein.

What is claimed is:

1. A toner comprising at least a binder resin and a colorant, wherein:

the binder resin contains a hybrid resin which contains a polyester-type resin unit by 50 mass % or more and in which a polyester-type resin component and a vinyl-type resin component are chemically bonded;

the toner contains 3 mass % or more and 50 mass % or less of a tetrahydrofuran-insoluble matter derived from the binder resin;

the tetrahydrofuran-insoluble matter contains a hybrid resin; and a tetrahydrofuran-soluble matter, obtained by hydrolyzing the tetrahydrofuran-insoluble matter and separating by filtration, has, in a GPC-measured molecular weight distribution, the main peak within a molecular weight range of 50,000 to 500,000.

2. A toner according to claim 1, wherein the THF-soluble matter of the toner has, in the GPC-measured molecular weight distribution, the main peak within a molecular weight range of 2,000 to 30,000, and contains a component within a molecular weight range of 40,000 to 1,000,000 by 3 mass % or more and 30 mass % or less.

3. A toner according to claim 1, wherein the binder resin contains a hybrid resin obtained by bulk polymerizing a vinyl-type monomer in the presence of an unsaturated polyester resin, and the bulk polymerization is executed with a mass ratio of the unsaturated polyester resin to the vinyl-type monomer within a range of 50:50 to 90:10.

4. A toner according to claim 1, wherein the tetrahydrofuran-insoluble matter contains 30 mass % or more and 80 mass % or less of a vinyl-type resin component.

5. A toner according to claim 1, wherein, in the THF-soluble matter obtained by dissolving the toner in tetrahydrofuran for 24 hours at 25° C., a component having an absolute molecular weight of $5.0\times10^5$ as measured by a GPC-RALLS viscosimeter analysis has a inertial square radius of 6.0 nm or more and 20.0 nm or less, and a component having an absolute molecular weight of $1.0\times10^7$ has a inertial square radius of 50.0 nm or more and 100.0 nm or less.

6. A toner according to claim 5, wherein, in the THF-soluble matter obtained by dissolving the toner in tetrahydrofuran for 24 hours at 25° C., a component having an absolute molecular weight of $2.0\times10^6$ as measured by a GPC-RALLS viscosimeter analysis has a inertial square radius of 16.0 nm or more and 60.0 nm or less.

7. A toner according to claim 5, wherein, when the logarithmic value (log[Rt]) of the inertial square radius Rt, which is measured by a GPC-RALLS viscosimeter analysis on a THF-soluble matter obtained by dissolving the toner in tetrahydrofuran for 24 hours at 25° C., is plotted against the logarithmic value (log[M]) of the absolute molecular weight M, an inclination ($k_L$) in an absolute molecular weight range of $5.0\times10^5$ to $2.0\times10^6$ and an inclination ($k_H$) in an absolute molecular weight range of $2.0\times10^6$ to $1.0\times10^7$ satisfy a following relation (1) to (3):

$$0.8 \leqq k_L/k_H \leqq 1.2 \quad (1)$$

$$0 < k_L \quad (2)$$

$$0 < k_H \quad (3).$$

* * * * *